US009561922B2

(12) United States Patent
Hiratsuka et al.

(10) Patent No.: US 9,561,922 B2
(45) Date of Patent: Feb. 7, 2017

(54) SHEET FEEDING DEVICE AND IMAGE FORMING APPARATUS

(71) Applicant: CANON KABUSHIKI KAISHA, Tokyo (JP)

(72) Inventors: Takashi Hiratsuka, Kashiwa (JP); Takaaki Aoyagi, Kawasaki (JP); Takeshi Aoyama, Kawasaki (JP); Yasumi Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/776,942

(22) PCT Filed: Apr. 10, 2014

(86) PCT No.: PCT/JP2014/060412
§ 371 (c)(1),
(2) Date: Sep. 15, 2015

(87) PCT Pub. No.: WO2014/168209
PCT Pub. Date: Oct. 16, 2014

(65) Prior Publication Data

US 2016/0031662 A1 Feb. 4, 2016

(30) Foreign Application Priority Data

Apr. 12, 2013 (JP) ..... 2013-083584

(51) Int. Cl.
*B65H 3/18* (2006.01)
*B65H 3/04* (2006.01)
*B65H 5/06* (2006.01)

(52) U.S. Cl.
CPC ..... *B65H 3/18* (2013.01); *B65H 3/047* (2013.01); *B65H 5/062* (2013.01);
(Continued)

(58) Field of Classification Search
CPC ..... B65H 3/18; B65H 3/047; B65H 3/04; B65H 2301/44334
See application file for complete search history.

(56) References Cited

U.S. PATENT DOCUMENTS 5,305,995 A 4/1994 Nakajima et al.
5,478,066 A 12/1995 Yoshida et al.
(Continued)

FOREIGN PATENT DOCUMENTS

CN 1677270 A 10/2005
CN 101891069 A 11/2010
(Continued)

OTHER PUBLICATIONS

International Search Report issued in International Application No. PCT/JP2014/060412 dated Jun. 24, 2014.
(Continued)

*Primary Examiner* — Luis A Gonzalez
(74) *Attorney, Agent, or Firm* — Fitzpatrick, Cella, Harper & Scinto

(57) ABSTRACT

Provided is a sheet feeding device and an image forming apparatus capable of performing sheet feeding by electrostatic adsorption at a low noise with a simple configuration. A first outer nip conveying roller 201*b* and a second outer nip conveying roller 202*b* that nip an adsorbing member 200 supported in a state an inside is loose by a first inner nip conveying roller 201*a* and a second inner nip conveying roller 202*b* are provided.

14 Claims, 16 Drawing Sheets

(52) U.S. Cl.
CPC ..... *B65H 2301/44334* (2013.01); *B65H 2404/27* (2013.01); *B65H 2404/283* (2013.01); *B65H 2555/41* (2013.01)

(56) References Cited

U.S. PATENT DOCUMENTS

| | | | | |
|---|---|---|---|---|
| 5,645,274 | A | 7/1997 | Ubayashi et al. | |
| 5,681,036 | A | 10/1997 | Wakahara et al. | |
| 5,722,652 | A | 3/1998 | Yoshida et al. | |
| 7,532,839 | B2 | 5/2009 | Ishii | |
| 8,342,507 | B2 | 1/2013 | Takahashi et al. | |
| 8,408,532 | B2 * | 4/2013 | Higaki ..... | B65H 3/18 271/18.1 |
| 8,523,107 | B2 | 9/2013 | Nishida et al. | |
| 8,523,170 | B2 * | 9/2013 | Nishida ..... | B65H 3/047 271/18.1 |
| 8,606,153 | B2 | 12/2013 | Hiratsuka et al. | |
| 8,746,675 | B2 | 6/2014 | Nishida et al. | |
| 2011/0204558 | A1 | 8/2011 | Takahashi et al. | |
| 2011/0227275 | A1 | 9/2011 | Poh et al. | |
| 2012/0170960 | A1 | 7/2012 | Nishida et al. | |
| 2013/0300052 | A1 | 11/2013 | Nishida et al. | |

FOREIGN PATENT DOCUMENTS

| | | | |
|---|---|---|---|
| CN | 102227364 | A | 10/2011 |
| JP | 58-202230 | A | 11/1983 |
| JP | 59-112839 | U | 7/1984 |
| JP | 05-139548 | A | 6/1993 |
| JP | 06-255823 | A | 9/1994 |
| JP | 07-112892 | B2 | 12/1995 |
| JP | 2011-168396 | A | 9/2011 |
| JP | 2012-140224 | A | 7/2012 |
| JP | 5605678 | B2 | 10/2014 |
| JP | 5685943 | B2 | 3/2015 |

OTHER PUBLICATIONS

Chinese Office Action issued in corresponding Chinese Patent Application No. 201480020817.3 dated Jul. 5, 2016 (with English translation).

* cited by examiner

SHEET FEEDING DEVICE AND IMAGE FORMING APPARATUS

TECHNICAL FIELD

The present invention relates to a sheet feeding device and an image forming apparatus, and more particularly, to a technique of feeding a sheet using electrostatic adsorption force.

BACKGROUND ART

An image forming apparatus such as a copying machine or a printer according to a related art includes a sheet feeding device that feeds a sheet, and as the sheet feeding device, there is a friction feed system in which a topmost sheet is separated and fed from a cassette on which a sheet bundle is loaded using frictional force of a rubber roller or the like. In the sheet feeding device of the friction feed system, the topmost sheet is fed by the rubber roller rotating while pressing the sheet bundle. Here, when a sheet is fed, multi-sheet feeding in which a plurality of sheets are conveyed by friction between sheets may occur. On the other hand, conveyance resistance works on the remaining sheets excluding the topmost sheet through a separating pad or a retard roller, and thus only the topmost sheet is fed to an image forming portion.

Meanwhile, in the sheet feeding device of the friction separation system, since the rubber roller feeds a sheet while applying great pressure to the sheet, noise generated by sliding friction between sheets or between the sheet and the rubber roller is problematic. In addition, when the multi-sheet feeding caused by the separating pad or the retard roller is prevented, sliding fricative between sheets is greatly generated. Further, since the separating pad or the retard roller serves as conveyance resistance of the topmost sheet even when the multi-sheet feeding does not occur, a sound is generated by stick slip between the separating pad or the retard roller and the sheet.

In this regard, as a technique of solving the problem, there is a sheet feeding device configured to separate and feed a sheet while adsorbing the sheet using electrostatic adsorption force, specifically, by an electric field formed on a belt surface (see Patent Literatures 1, 2, and 3). In the sheet feeding device of the electrostatic adsorption separation system, since it is possible to convey the topmost sheet as if the topmost sheet is peeled off from the sheet bundle, it is possible to significantly reduce noise generated in a feeding portion.

CITATION LIST

Patent Literature

Patent Literature 1: Japanese Patent Laid-Open No. 2011-168396

Patent Literature 2: Japanese Patent Laid-Open No. 5-139548

Patent Literature 3: Japanese Patent Laid-Open No. 2012-140224

SUMMARY OF INVENTION

Technical Problem

However, in the sheet feeding device of the related art that feeds the sheet using electrostatic adsorption force, in a configuration of Patent Literature 1, it is possible to apply sufficient electrostatic adsorption force to the sheet, but when the sheet is separated, since lifting and lowering are performed for each frame on which the adsorbing belt is carried, an operation sound occurs. A collision sound with the sheet occurs as well. Further, when the sheet is adsorbed, belt tension is reduced by reducing an inter-axial distance so that a sheet can be adsorbed with certainty even when a sheet curls, that is, so that followability to the sheet curl can be secured when the adsorbing belt adsorbs the sheet. However, when the sheet is adsorbed in a state in which belt tension is reduced, it is necessary to increase tension at the time of the separation operation, and when the tension is increased as described above, string vibration occurs in the belt, and a sudden sound is caused by the vibration.

In a configuration of Patent Literature 2, the adsorbing belt is used, but since the sheet separation operation is performed by causing the carrying roller to perform an eccentric motion instead of lifting and lowering the adsorbing belt for each frame, a machinery operation sound is reduced. However, when the adsorbing belt comes into contact with the sheet bundle with certainty, the roller collides with the sheet bundle through the adsorbing belt, and thus a collision sound still occurs. Further, when an attempt to prevent a collision between the roller and the sheet bundle is made, the belt is separated from the sheet bundle, sheet adsorption by the adsorbing belt becomes unstable, leading to a feeding failure. In a configuration of Patent Literature 3, since there is a limitation to increasing a looseness amount of the belt, it is necessary to install a mechanism for separating an adsorbed sheet.

In this regard, in light of the foregoing, it is an object of the present invention to provide a sheet feeding device and an image forming apparatus, which are capable of stably performing sheet feeding by electrostatic adsorption at a low noise with a simple configuration.

Solution to Problem

The present invention provides a sheet feeding device, which includes a loading unit that loads a sheet, a first rotating member that is arranged above the loading unit, a second rotating member that is arranged in a downstream further than the first rotating member in a sheet feed direction, an adsorbing member in which an inside is supported in a loose state by the first rotating member and the second rotating member and electrically adsorbs the sheet loaded on the loading unit, a first nip member that nips the adsorbing member together with the first rotating member, a second nip member that nips the adsorbing member together with the second rotating member, a driving unit that rotates the first rotating member, the first nip member, the second rotating member, and the second nip member, and a control unit that controls the driving unit, wherein the control unit causes the sheet loaded on the loading unit to be adsorbed on the adsorbing member by increasing an downward looseness amount of the adsorbing member and then feeds the sheet adsorbed on the adsorbing member while reducing the downward looseness amount of the adsorbing member.

Advantageous Effects of Invention

According to the present invention, since the first nip member and the second nip member that nip the adsorbing member in which an inside is supported in the loose state by the first rotating member and the second rotating member are provided, sheet feeding by electrostatic adsorption can be stably performed at a low noise with a simple configuration. Further, according to the present invention, since it is possible to increase the looseness amount of the adsorbing member and deform the sheet adsorbed on the adsorbing member 200, it is possible to separate the adsorbed sheet from the next sheet due to the stiffness of the sheet.

DESCRIPTION OF EMBODIMENTS

Figure 1:
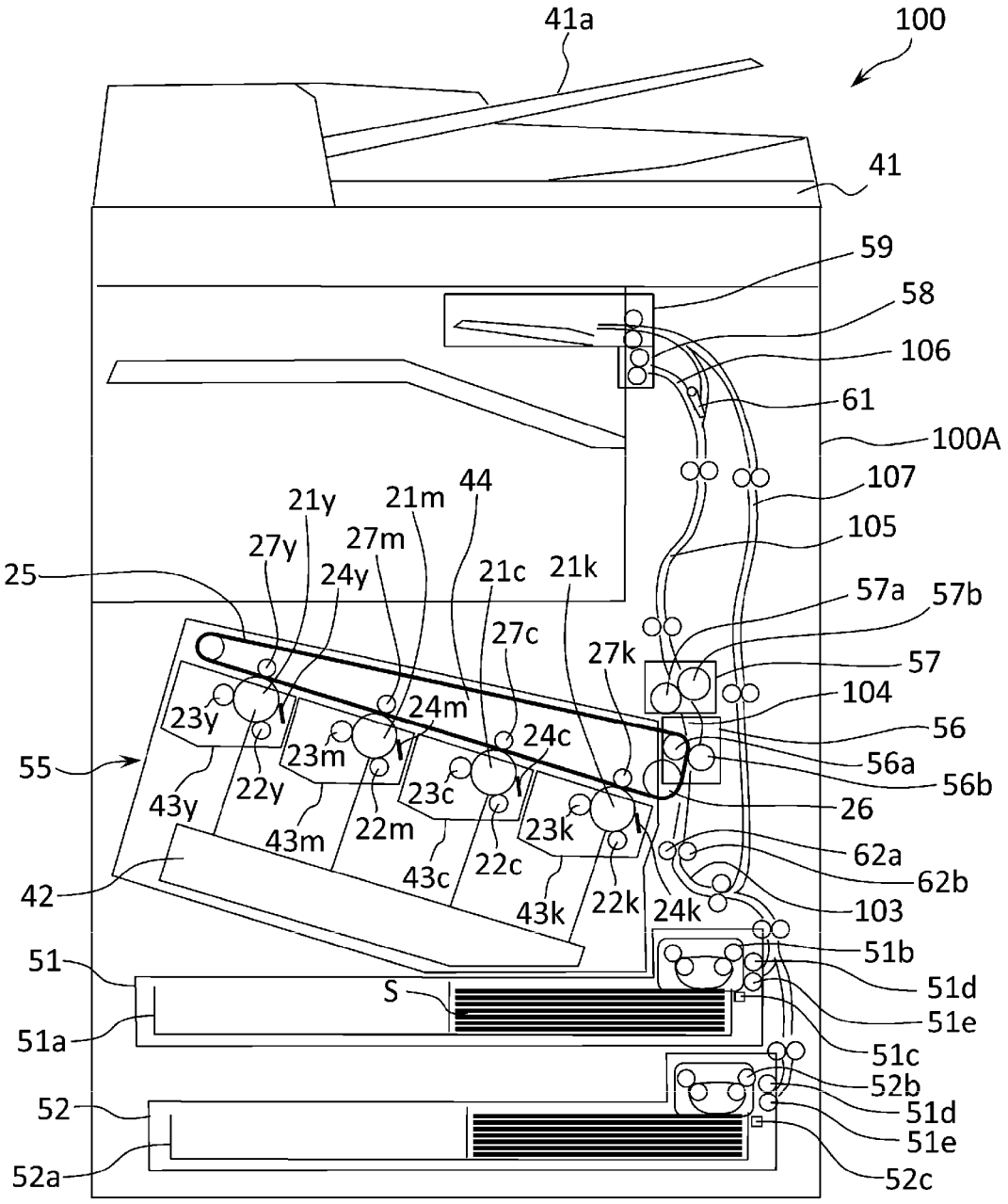
FIG. 1 is a diagram illustrating a schematic configuration of an image forming apparatus equipped with a sheet feeding device according to a first embodiment of the present invention.

Hereinafter, embodiments of the present invention will be described in detail with reference to the appended drawings. FIG. 1 is a diagram illustrating a schematic configuration of an image forming apparatus equipped with a sheet feeding device according to a first embodiment of the present invention.

In FIG. 1, 100 indicates an image forming apparatus, and 100A indicates an image forming apparatus body (hereinafter, referred to as an "apparatus body"). An image reading portion 41 that includes an image sensor of irradiating an original placed on a platen glass serving as an original placing platen with light and converting reflected light into a digital signal and the like is arranged above the apparatus body 100A. An original from which an image is read is conveyed on the platen glass by an automatic original feeding device 41*a*. An image forming portion 55, sheet feeding devices 51 and 52 of feeding a sheet S to the image forming portion 55, and a sheet reversing portion 59 of reversing the sheet S and conveying the reversed sheet S to the image forming portion 55 are arranged in the apparatus body 100A.

The image forming portion 55 includes an exposure unit 42 and four process cartridges 43 (43*y*, 43*m*, 43*c*, and 43*k*) for forming toner images of four colors, that is, yellow (Y), magenta (M), cyan (C), and black (Bk). The image forming portion 55 further includes an intermediate transfer unit 44, a secondary transfer portion 56, and a fixing portion 57 arranged above the process cartridge 43.

Here, the process cartridge 43 includes a photosensitive drum 21 (21*y*, 21*m*, 21*c*, and 21*k*), a charging roller 22 (22*y*, 22*m*, 22*c*, and 22*k*), and a developing roller 23 (23*y*, 23*m*, 23*c*, and 23*k*). The process cartridge 43 further includes a drum cleaning blade 24 (24*y*, 24*m*, 24*c*, and 24*k*).

The intermediate transfer unit 44 includes a belt driving roller 26, an intermediate transfer belt 25 stretching to an inner secondary transfer roller 56*a* or the like, and primary transfer roller 27 (27*y*, 27*m*, 27*c*, and 27*k*) that abuts the intermediate transfer belt 25 at a position opposite to the photosensitive drum 21. As will be described later, as transfer bias of a positive polarity is applied to the intermediate transfer belt 25 through the primary transfer roller 27, toner images having a negative polarity on the photosensitive drum 21 are sequentially multi-transferred onto the intermediate transfer belt 25. As a result, a full color image is formed on the intermediate transfer belt 25.

The secondary transfer portion 56 is configured with the inner secondary transfer roller 56*a* and an outer secondary transfer roller 56*b* that comes into contact with the inner secondary transfer roller 56*a* with the intermediate transfer belt 25 interposed therebetween. Further, as will be described later, as secondary transfer bias of a positive polarity is applied to the outer secondary transfer roller 56*b*, the full color image formed on the intermediate transfer belt 25 is transferred onto the sheet S.

The fixing portion 57 includes a fixing roller 57*a* and a fixing backup roller 57*b*. The sheet S is nipped and conveyed between the fixing roller 57*a* and the fixing backup roller 57*b*, and thus the toner image on the sheet S is pressed and heated, and then fixed onto the sheet S. The sheet feeding devices 51 and 52 include cassettes 51*a* and 52*a*, respectively, serving as a storage unit (loading unit) that stores the sheet S and sheet adsorption separation feeding portions 51*b* and 52*b*, respectively, having a function of feeding the sheets S one by one while adsorbing the sheet S stored in the cassettes 51*a* and 52*a* by static electricity.

In FIG. 1, 103 indicates a pre-secondary transfer conveyance path in which the sheet S fed from the cassettes 51*a* and 52*a* is conveyed to the secondary transfer portion 56, and 104 indicates a pre-fixing conveyance path in which the sheet S conveyed to the secondary transfer portion 56 is conveyed from the secondary transfer portion 56 to the fixing portion 57. 105 indicates a post-fixing conveyance path in which the sheet S conveyed to the fixing portion 57 is conveyed from a fixing portion 57 to a switching member 61, and 106 indicates a discharge path in which the sheet S conveyed to the switching member 61 is conveyed from the switching member 61 to a discharge portion 58. 107 is a re-conveyance path in which the sheet S reversed by the sheet reversing portion 59 is conveyed to the image forming portion 55 again in order to form an image on a reverse side of the sheet S having an image formed on one surface thereof by the image forming portion 55.

Next, an image forming operation of the image forming apparatus 100 having the above configuration will be described. When the image forming operation starts, the exposure unit 42 first irradiates the surface of the photosensitive drum 21 with laser beams based on image information provided from a personal computer (not illustrated) or the like. At this time, the surface of the photosensitive drum 21 is uniformly charged to a predetermined polarity and potential by the charging roller 22, and when the laser beams are irradiated, charges of a portion irradiated with the laser beams are attenuated, and thus an electrostatic latent image is formed on the surface of the photosensitive drum.

Thereafter, the electrostatic latent image is developed by yellow (Y), magenta (M), cyan (C), and black (Bk) toners supplied from the developing roller 23, and thus the electrostatic latent image is visualized as toner images. Then, the toner images of the respective colors are sequentially transferred onto the intermediate transfer belt 25 by primary transfer bias applied to the primary transfer roller 27, and thus a full color toner image is formed on the intermediate transfer belt 25.

On the other hand, in parallel with the toner image forming operation, in the sheet feeding devices 51 and 52, only one piece of sheet S is separated and fed from the cassettes 51*a* and 52*a* through the sheet adsorption separation feeding portions 51*b* and 52*b*. Thereafter, the sheet S is detected by sheet leading end detecting sensors 51*c* and 52*c* and reaches a pair of drawing rollers 51*d* and 51*e*. Further, the sheet S nipped between the pair of drawing rollers 51*d* and 51*e* is fed to the conveyance path 103 and abuts a pair of registration rollers 62*a* and 62*b* that is stopped, so that a position of the leading end thereof is adjusted.

Then, in the secondary transfer portion 56, the pair of registration rollers 62*a* and 62*b* are driven at a timing at which the full color toner image on the intermediate transfer belt matches the position of the sheet S. As a result, the sheet S is conveyed to the secondary transfer portion 56, and in the secondary transfer portion 56, the full color toner image is collectively transferred onto the sheet S through secondary transfer bias applied to the outer secondary transfer roller 56*b*.

The sheet S onto which the full color toner image has been transferred is conveyed to the fixing portion 57 and receives heat and pressure in the fixing portion 57, and the toners of the respective colors undergo melting and color mixture and are fixed as a full color image to the sheet S. Thereafter, the sheet S to which the image has been fixed is discharged through the discharge portion 58 installed in the downstream of the fixing portion 57. Further, when an image is formed on both sides of the sheet, the conveyance direction of the sheet S is reversed by the sheet reversing portion 59, so that the sheet S is conveyed to the image forming portion 55 again.

Next, a configuration of the sheet feeding device 51 according to the present embodiment will be described with reference to FIG. 2. As described above, the sheet feeding device 51 includes the cassette 51*a* and the sheet adsorption separation feeding portion 51*b* that feeds the sheets S one by one while adsorbing the sheet S stored in the cassette 51*a* by static electricity. The sheet feeding device 51 further includes a lifting and lowering unit 301 that is installed to be lifted and lowered in the cassette 51*a* and lifts and lowers a sheet supporting plate 301*a* in which the sheets S are loaded and the sheet leading end detecting sensor 51*c* that detects the passage of the sheet S fed by the sheet adsorption separation feeding portion 51*b*.

The lifting and lowering unit 301 includes a lifter 301*b* that is installed to be rotatable down the sheet supporting plate 301*a*, and changes the position of the sheet supporting plate 301*a* and the position of a topmost sheet Sa loaded on the sheet supporting plate 301*a* according to a rotation angle of the lifter 301*b*. The sheet leading end detecting sensor 51*c* is arranged in the sheet conveyance path between the sheet adsorption separation feeding portion 51*b* and the pair of drawing rollers 51*d* and 51*e*. Success or failure of sheet feeding is detected by detecting whether or not the sheet leading end detecting sensor 51*c* detects the sheet S at a predetermined timing. In the present embodiment, the sheet leading end detecting sensor 51*c* is a non-contact reflective photo sensor, and detects the presence or absence of a detection target by irradiating the detection target with spotlight and measuring reflected light quantity thereof.

The sheet adsorption separation feeding portion 51*b* includes a pair of first nip conveying rollers 201, a pair of second nip conveying rollers 202, and an endless adsorbing member 200 that is nipped and conveyed by the pair of first nip conveying rollers 201 and the pair of second nip conveying rollers 202 and has flexibility. A sheet adsorption separation feeding portion 52*b* installed in the sheet feeding device 52 has the same configuration as the sheet adsorption separation feeding portion 51*b* of the sheet feeding device 51, and thus a description thereof is omitted.

Figure 2:
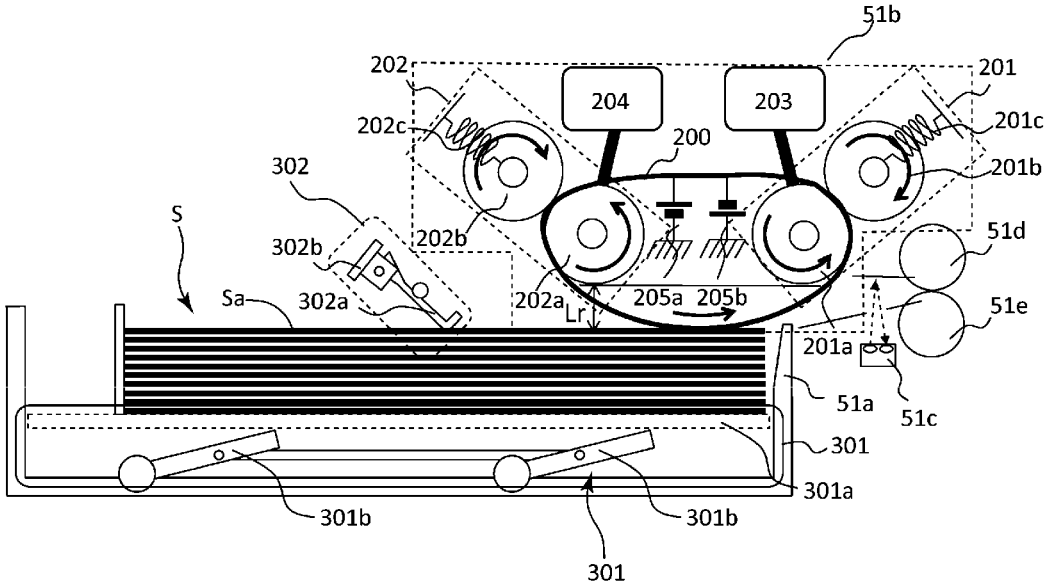
FIG. 2 is a diagram for describing a configuration of the sheet feeding device.
Figure 3A:
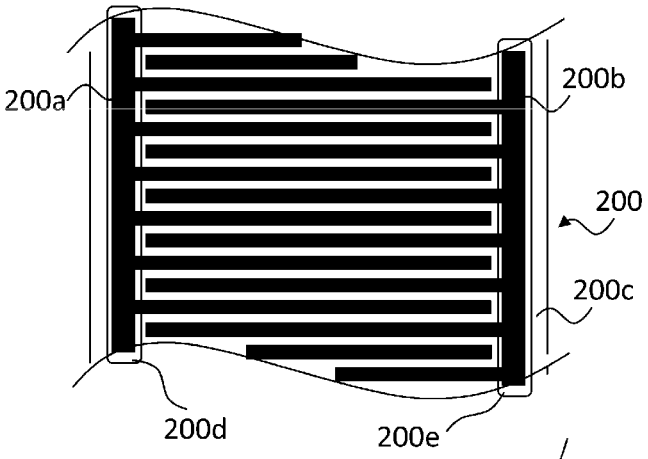
FIG. 3 is a diagram for describing a detailed configuration of an adsorbing member of a sheet adsorption separation feeding portion installed in the sheet feeding device and a generation principle of adsorption force by which the adsorbing member adsorbs a sheet.
Figure 3B:
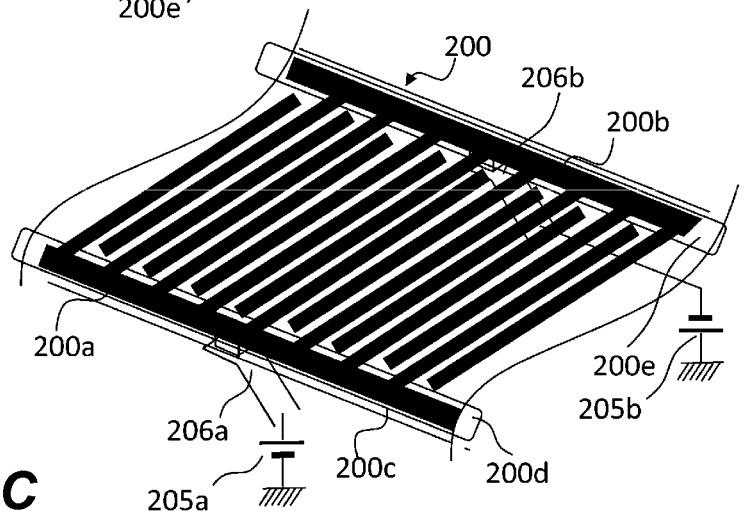
Figure 3C:
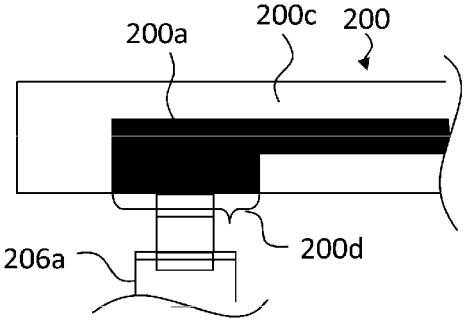
Figure 3D:
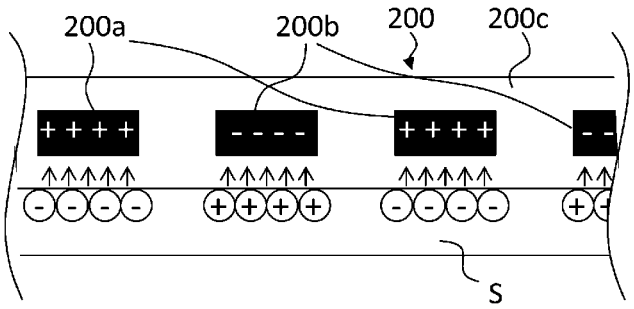

In FIG. 2, 302 indicates a plane of paper height detecting unit that detects the top surface position of the sheet S loaded on the sheet supporting plate 301*a*. The plane of paper height detecting unit 302 is arranged above the sheet supporting plate 301*a* and configured with a sensor flag 302*a* and a photo sensor 302*b*. The sensor flag 302*a* is rotatably supported on a support portion (not illustrated), and one end of the sensor flag 302*a* is arranged at a position at which it can come into contact with the top surface of the topmost sheet Sa, and the other end of the sensor flag 302*a* is arranged at a position at which it can light-shield the photo sensor 302*b*.

Here, when the top surface of the topmost sheet Sa is positioned at a predetermined height, the sensor flag 302*a* rotates, and the photo sensor 302*b* is light-shielded. A controller 70 of FIG. 4 which will be described later detects the position of the top surface of the topmost sheet Sa by detecting the light-shielding state of the photo sensor 302*b*. The controller 70 controls an operation of the lifting and lowering unit 301 such that the top surface of the topmost sheet Sa is consistently detected by the plane of paper height detecting unit 302, and maintains the position of the sheet supporting plate 301*a* to be a position at which the height of the top surface of the topmost sheet Sa is almost constant.

As a result, a gap Lr between the pair of first nip conveying rollers 201 and the pair of second nip conveying rollers 202 and the top surface of the topmost sheet Sa is maintained to be almost constant. In the present embodiment, the gap between the pair of first nip conveying rollers 201 and the top surface position of the sheet S and the gap between the pair of second nip conveying rollers 202 and the top surface position of the sheet S are described as being equal to each other, that is, Lr, but the gaps need not be necessarily equal to each other.

The pair of first nip conveying rollers 201 is arranged in the downstream of the pair of second nip conveying rollers 202 in the sheet feeding direction and configured with a first inner nip conveying roller (a first rotating member) 201*a* and a first outer nip conveying roller (a first nip member) 201*b*. The first inner nip conveying roller 201*a* is arranged inside the adsorbing member 200 and rotatably shaft-supported by a shaft support member (not illustrated) whose arrangement position is fixed, and driving from a first driving unit 203 is transmitted to the first inner nip conveying roller 201*a* through a driving transmission unit (not illustrated).

The first outer nip conveying roller 201*b* serving as a driven rotary member is arranged outside the first inner nip conveying roller 201*a* with the adsorbing member 200 of an endless belt shape interposed therebetween and rotatably shaft-supported by a shaft support member (not illustrated). A first pressing spring 201*c* is connected to the shaft support member (not illustrated), and the first outer nip conveying roller 201*b* is biased in a shaft center direction of the first inner nip conveying roller 201*a* by the first pressing spring 201*c* to nip the sheet S together with the first inner nip conveying roller 201*a*.

The pair of second nip conveying rollers 202 is configured with a second inner nip conveying roller (a second rotating member) 202*a* and a second outer nip conveying roller (a second nip member) 202*b*. Similarly to the first inner nip conveying roller 201*a*, the second inner nip conveying roller 202*a* is arranged inside the adsorbing member 200 and rotatably shaft-supported by a shaft support member (not illustrated) whose arrangement position is fixed. Further, driving force is transmitted from a second driving unit 204 to the second inner nip conveying roller 202*a* through a driving transmission unit (not illustrated).

Similarly to the first outer nip conveying roller 201*b*, the second outer nip conveying roller 202*b* serving as a driven rotary member is arranged outside the second inner nip conveying roller 202*a* with the adsorbing member 200 interposed therebetween and rotatably shaft-supported by a shaft support member (not illustrated). A second pressing spring 202*c* is connected to a shaft support member (not illustrated), and the second outer nip conveying roller 202*b* is biased in the shaft center direction of the second inner nip conveying roller 202*a* by the second pressing spring 202*c* to nip the sheet S together with the second inner nip conveying roller 202*a*.

The adsorbing member 200 of the endless shape is supported to a plurality of rotary members directed in the sheet feeding direction, two rotary members in the present embodiment, that is, the first inner nip conveying roller 201*a* and the second inner nip conveying roller 202*a*. The adsorbing member 200 has a length larger than [twice an inter-rotation center distance between the first inner nip conveying roller 201*a* and the second inner nip conveying roller 202*a*+half the length of the circumferential surface of each of the rollers 201*a* and 202*a*]. Since the adsorbing member 200 has such a length, the adsorbing member 200 can be bent downward while rotating (moving) with the rotation of the first inner nip conveying roller 201*a* and the second inner nip conveying roller 202*a*. Thus, although there is the gap Lr between the pair of first nip conveying rollers 201 and the pair of second nip conveying rollers 202 and the topmost sheet Sa among the sheets S loaded on the sheet supporting plate 301*a*, the adsorbing member 200 can come into contact with the topmost sheet Sa.

Here, in the present embodiment, when the sheet is adsorbed and conveyed by the adsorbing member 200, the sheet is adsorbed on the adsorbing member 200 by static electricity so that the sheets do not undergo sliding friction, and then the adsorbing member 200 is pulled upward while being elastically deformed. As the adsorbing member 200 is pulled upward while being elastically deformed, the sheet is separated from another sheet.

In this regard, in the present embodiment, the length of the adsorbing member 200 is decided so that a sheet contact area Mn in which sheet adsorption force for necessary for the adsorption separation is obtained is secured. A positive voltage supply unit 205*a* to which a positive voltage is supplied and a negative voltage supply unit 205*b* to which a negative voltage is supplied are electrically connected to the adsorbing member 200. Electrostatic adsorption force of attracting the sheet S is generated in the adsorbing member 200 by the positive and negative voltages supplied from the positive voltage supply unit 205*a* serving as a first power source and the negative voltage supply unit 205*b* serving as a second power source.

Next, a detailed configuration of the adsorbing member 200 and a generation principle of adsorption force by which the adsorbing member 200 adsorbs the sheet S will be described with reference to FIG. 3. (a) of FIG. 3 is a diagram illustrating the surface of the adsorbing member, (b) of FIG. 3 is a perspective view of the adsorbing member 200, (c) of FIG. 3 is a diagram illustrating a cross section of a power supply portion of the adsorbing member 200, and (d) of FIG. 3 is a diagram illustrating a concept of electrostatic adsorption force working between the adsorbing member 200 and the sheet S.

As illustrated in FIG. 3, the adsorbing member 200 includes a base layer 200*c*, a positive electrode 200*a* serving as a first electrode, and a negative electrode 200*b* serving as a second electrode. The positive electrode 200*a* and the negative electrode 200*b* have a comb teeth shape and are alternately arranged inside the base layer 200*c*. In the present embodiment, the base layer 200*c* is of polyimide serving as a dielectric having volume resistance of 108 Ωcm or more and has a thickness of about 100 μm. The positive electrode 200*a* and the negative electrode 200*b* are conductors having volume resistance of 106 Ωcm or less and made of copper having a thickness of about 10 μm.

In the present embodiment, as will be described later, when the adsorbing member 200 approaches the sheet S, the adsorbing member 200 has appropriate elasticity by adjusting, for example, a material and a thickness of the adsorbing member 200 so that the adsorbing member 200 is bent downward to have a barrel shape. Exposed regions 200*d* and 200*e* in which the positive electrode 200*a* and the negative electrode 200*b* are exposed are formed on the inner circumferential surface of the adsorbing member 200 that approaches the first inner nip conveying roller 201*a* and the second inner nip conveying roller 202*a*. A positive contact point 206*a* connected with the positive voltage supply unit 205*a* comes into contact with the exposed region 200*d* of the positive electrode 200*a*, and a negative contact point 206*b* connected with the negative voltage supply unit 205*b* comes into contact with the exposed region 200*e* of the negative electrode 200*b*.

In the present embodiment, a positive voltage of about +1 kV is applied to the positive electrode 200*a*, and a negative voltage of about −1 kV is applied to the negative electrode 200*b*. The positive contact point 206*a* and the negative contact point 206*b* have a structure in which a carbon brush is caulked to a leading end of a metallic plate having elasticity, and the carbon brush comes into contact with the exposed regions 200*d* and 200*e* of the positive electrode 200*a* and the negative electrode 200*b*. Since the positive contact point 206*a* and the negative contact point 206*b* have the elasticity, the positive contact point 206*a* and the negative contact point 206*b* can come into contact with the adsorbing member 200 while following the adsorbing member 200 whose cross-sectional shape changes from hour to hour, and thus electric power can be stably supplied.

Here, as illustrated in (d) of FIG. 3, when the positive and negative voltages are applied to the positive electrode 200*a* and the negative electrode 200*b*, respectively, an unequal electric field is formed near the surface of the adsorbing member 200 due to the positive electrode 200*a* and the negative electrode 200*b* to which the voltages are applied. When the adsorbing member 200 in which the unequal electric field is formed approaches the sheet S, dielectric polarization occurs on the surface layer of the sheet serving as a dielectric, and electrostatic adsorption force is generated between the adsorbing member 200 and the sheet S due to Maxwell's stress.

Figure 4:
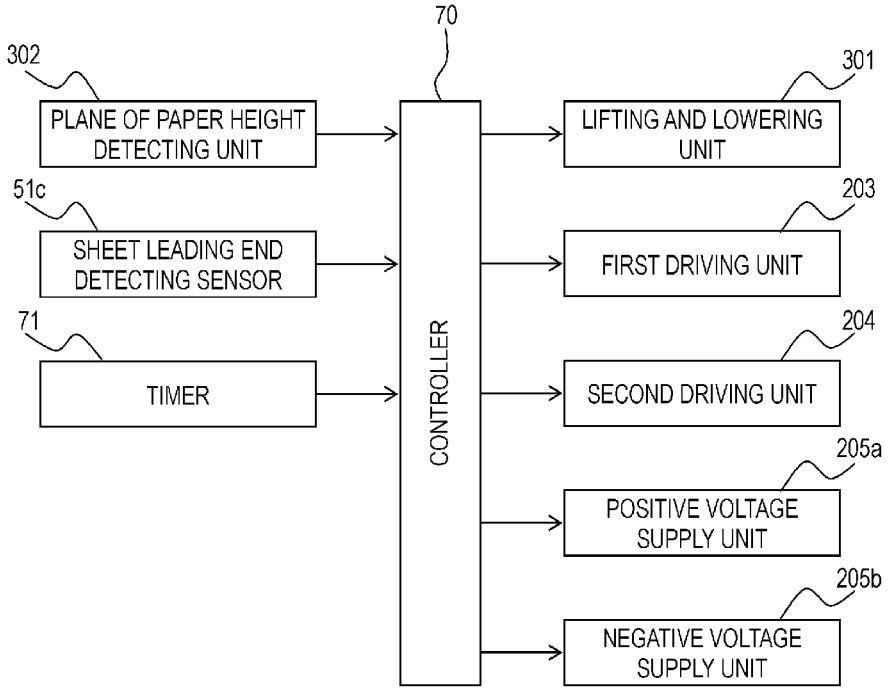
FIG. 4 is a control block diagram of the sheet feeding device.
Figure 5A:
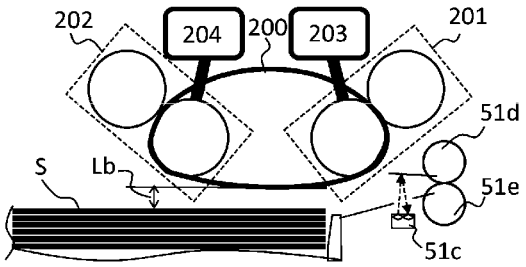
FIG. 5 is a diagram for describing a sheet separation feeding operation of the sheet adsorption separation feeding portion.
Figure 5B:
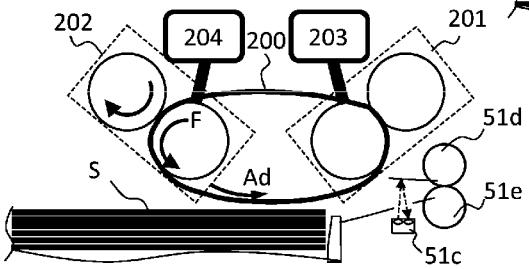
Figure 5C:
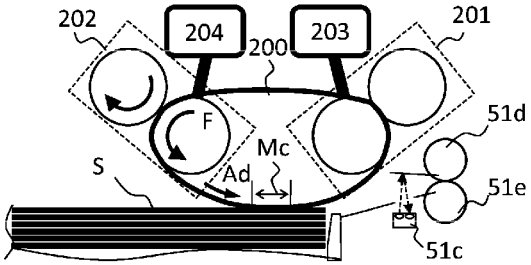
Figure 5D:
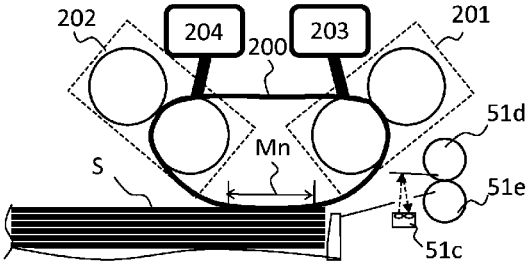
Figure 5E:
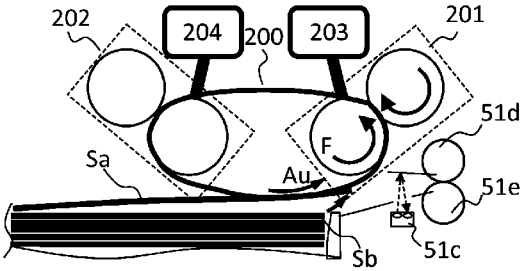
Figure 5F:
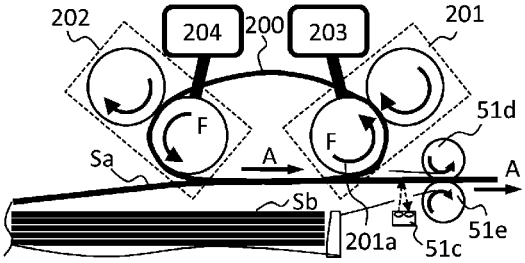

FIG. 4 is a control block diagram of the sheet feeding device 51 according to the present embodiment, and in FIG. 4, 70 is a controller. In addition to the sheet leading end detecting sensor 51*c*, the plane of paper height detecting unit 302, and the like, the first driving unit 203, the second driving unit 204, the positive voltage supply unit 205*a*, the negative voltage supply unit 205*b*, a timer 71, and the like are connected to the controller 70.

Next, the sheet separation feeding operation of the sheet adsorption separation feeding portion 51*b* according to the present embodiment will be described with reference to FIG. 5. FIG. 5 is a schematic diagram illustrating an operation of feeding the sheet S through the sheet adsorption separation feeding portion 51*b* chronologically. The feeding operation of the sheet S includes six processes chronologically, that is, an initial operation, an approach operation, a contact area increase operation, an adsorption operation, a separation operation, and a conveyance operation illustrated in (a) to (f) of FIG. 5. The processes will be described below in order. In the present embodiment, in each operation process, the positive voltage supply unit 205*a* and the negative voltage supply unit 205*b* are connected to the adsorbing member 200, and adsorption force is consistently generated. In the present embodiment, the loaded sheet is adsorbed on the adsorbing member 200 by increasing a downward looseness amount of the adsorbing member 200, and thereafter the sheet adsorbed on the adsorbing member 200 is fed while reducing the downward looseness amount of the adsorbing member 200. This will be described below in detail.

The initial operation illustrated in (a) of FIG. 5 is an operation of arranging the adsorbing member 200 at an initial feed operation position. In the present embodiment, at the time of the initial operation, the controller 70 causes the adsorbing member 200 to be separated from the topmost sheet Sa by a predetermined gap Lb, and stops the first driving unit 203 and the second driving unit 204.

The approach operation illustrated in (b) of FIG. 5 is an operation of causing the adsorbing member 200 to be bent downward (causes a bent portion to move downward) and to be deformed in a barrel shape and causing the adsorption surface side of the adsorbing member 200 to approach the topmost sheet Sa. At the time of this operation, the controller 70 causes the pair of second nip conveying rollers 202 to rotate in an arrow F direction through the second driving unit 204 and conveys the adsorbing member 200 in an arrow Ad direction. Further, at this time, the controller 70 causes the adsorbing member 200 to be deformed in the barrel shape by causing the pair of first nip conveying rollers 201 to be stopped or causing the pair of first nip conveying rollers 201 to rotate slower than the pair of second nip conveying rollers 202 through the first driving unit 203. As the adsorbing member 200 is deformed in the barrel shape as described above, the surface of the adsorbing member 200 comes into contact with the topmost sheet Sa.

The contact area increase operation illustrated in (c) of FIG. 5 is an operation of increasing a contact area Mc between the surface of the adsorbing member 200 that has moved to a position (an adsorption position) for adsorbing the sheet and the topmost sheet Sa by performing the approach operation continuously. At the time of this operation, similarly to the approach operation, the controller 70 causes the pair of second nip conveying rollers 202 to rotate in the arrow F direction through the second driving unit 204 and causes the adsorbing member 200 to be conveyed in the arrow Ad direction. Further, the controller 70 increases the contact area Mc by causing the pair of first nip conveying rollers 201 to be stopped or causing the pair of first nip conveying rollers 201 to rotate slower than the pair of second nip conveying rollers 202 through the first driving unit 203.

Then, the contact area increase operation is continued until the contact area Mc becomes equal to a predetermined contact area. Here, a detecting unit that directly detects the size of the contact area Mc may be installed, but in the present embodiment, the size of the contact area Mc is alternatively detected using a difference in a conveyance amount between the pairs of first and second nip conveying rollers 201 and 202 based on clocking by the timer 71.

The adsorption operation illustrated in (d) of FIG. 5 is an operation of causing the top surface of the topmost sheet Sa to come into surface contact with the surface of the adsorbing member 200 by a predetermined contact area Mn and then causing the topmost sheet Sa to be adsorbed on the adsorbing member 200. Here, when the topmost sheet Sa comes into contact with the adsorbing member 200, the voltages are applied to the adsorbing member 200 through the positive and negative voltage supply units 205*a* and 205*b* as described above, the electrostatic adsorption force works between the adsorbing member 200 and the sheet S. Then, when the adsorbing member 200 comes into surface contact with the topmost sheet Sa by a predetermined contact area Mn, the topmost sheet Sa is adsorbed on the adsorbing member 200. When the topmost sheet Sa is adsorbed on the adsorbing member 200, the controller 70 stops the first driving unit 203 and the second driving unit 204.

The separation operation illustrated in (e) of FIG. 5 is an operation of separating the topmost sheet Sa adsorbed on the adsorbing member 200 from a lower sheet Sb while elastically deforming the topmost sheet Sa upward by causing the adsorbing member 200 to be deformed in substantially a straight line form from the barrel shape. At the time of this operation, the controller 70 causes the adsorbing member 200 to rotate in an arrow Au direction by causing the pair of first nip conveying rollers 201 to rotate in the arrow F direction through the first driving unit 203. Further, the controller 70 eliminates the bending by causing the pair of second nip conveying rollers 202 to be stopped or causing the pair of second nip conveying rollers 202 to rotate slower than the pair of first nip conveying rollers 201 through the second driving unit 204, and causes the shape of the adsorbing member 200 to be deformed in substantially the straight line form. In other words, through the separation operation, the adsorbing member 200 moves the topmost sheet Sa to a position (a separation position) at which the topmost sheet Sa is separated from the lower sheet Sb.

The conveyance operation illustrated in (f) of FIG. 5 is an operation of conveying the adsorbing member 200 deformed in substantially the straight line form and adsorbing and feeding the adsorbed topmost sheet Sa to the pair of drawing rollers 51*d* and 51*e* serving as a sheet conveying unit at the sheet feed downstream. At the time of this operation, the controller 70 causes the rotation velocity of the pair of first nip conveying rollers 201 to substantially match the rotation velocity of the pair of second nip conveying rollers 202, and conveys the adsorbing member 200 adsorbing the sheet Sa in a state in which the adsorption surface side is maintained in substantially the straight line form.

As a result, the topmost sheet Sa adsorbed on the adsorbing member 200 is conveyed in an arrow A direction while maintaining a state in which at least the leading end portion separated from the adsorbing member 200 is separated from the lower sheet Sb due to the stiffness of the sheet Sa. Thereafter, when the leading end of the topmost sheet Sa reaches near a curved portion of the adsorbing member 200 formed by the first inner nip conveying roller 201*a*, the leading end of the topmost sheet Sa is peeled off from the adsorbing member 200. The peeling occurs since bending reaction force of the sheet Sa is larger than the electrostatic adsorption force generated in the adsorbing member 200. In other words, in the present embodiment, the magnitude of the electrostatic adsorption force occurring in the adsorbing member 200 is set so that the sheet is adsorbed by force smaller than the bending reaction force of the sheet Sa. That is, through the conveyance operation, the adsorbing member 200 is moved to a position (a releasing position) at which the topmost sheet Sa is separated from.

After the leading end is peeled off from the adsorbing member 200 as described above, the peeling of the topmost sheet Sa is increased starting from the leading end, but a rear end region of the sheet Sa is adsorbed by the adsorbing member 200. As a result, the sheet Sa is continuously conveyed by the adsorbing member 200 and then handed over to the pair of drawing rollers 51*d* and 51*e* through detection of the leading end by the sheet leading end detecting sensor 51*c*. Here, when the sheet Sa has not been detected during a predetermined period of time by the sheet leading end detecting sensor 51*c*, the controller 70 determines that there is a mistake in the feeding operation of the sheet Sa and resumes the feeding operation starting from the approach operation. One topmost sheet Sa is fed from a plurality of sheets S loaded on the cassette 51*a* through the above six processes. Further, it is possible to continuously feed the sheets S one by one by repeatedly performing the six processes.

Figure 6:
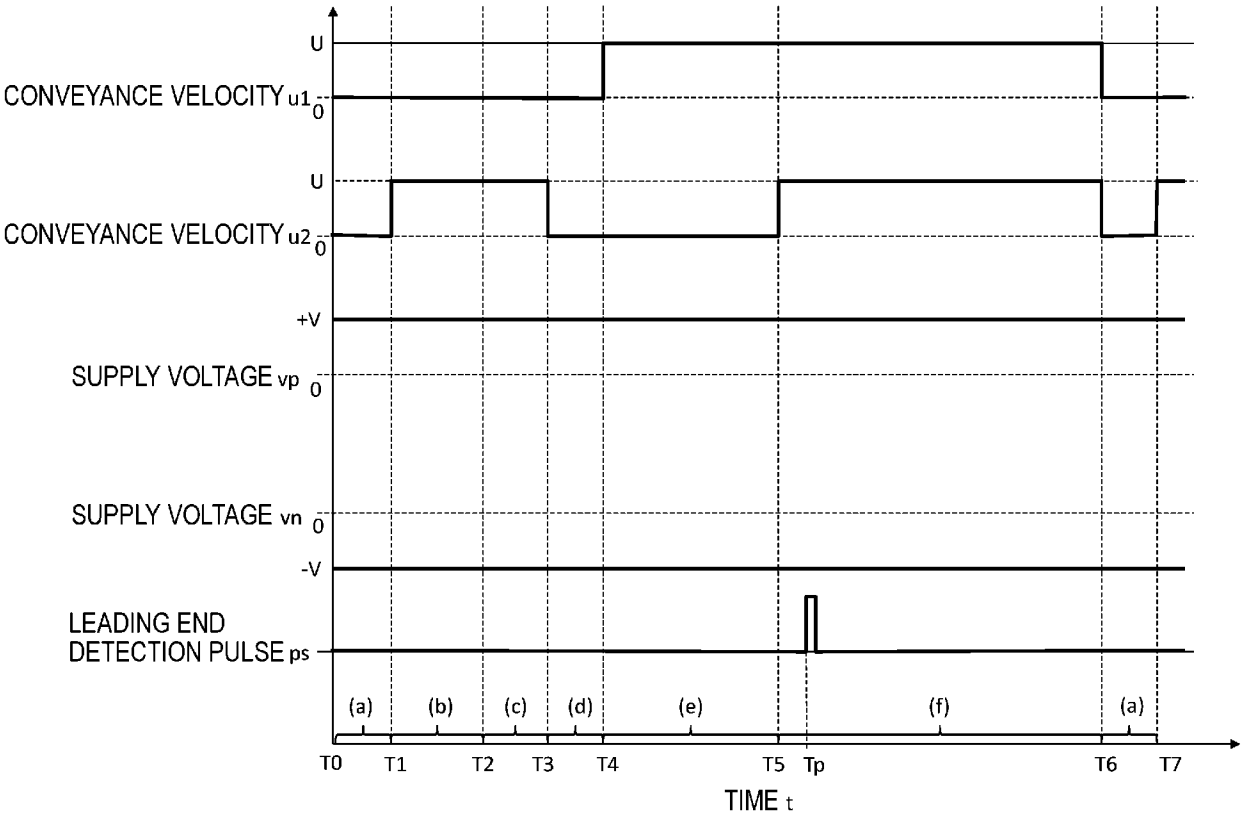
FIG. 6 is a timing chart of a time of sheet separation feeding of the sheet adsorption separation feeding portion.

FIG. 6 is a timing chart of the initial operation, the approach operation, the contact area increase operation, the adsorption operation, the separation operation, and the conveyance operation illustrated in FIG. 5. In FIG. 6, u1 indicates a conveyance velocity of the pair of first nip conveying rollers 201, and u2 indicates a conveyance velocity of the pair of second nip conveying rollers 202. Further, vp indicates a positive voltage supplied from the positive voltage supply unit 205*a*, vn indicates a negative voltage supplied from the negative voltage supply unit 205*b*, and ps indicates a detection pulse of the sheet leading end detecting sensor 51*c*.

In FIG. 6, a zone from a time T to a time T1 indicated by (a) is an initial operation zone, and at this time, the conveyance velocity u1 and the conveyance velocity u2 are set to 0, the supply voltage vp is set to +V, and the supply voltage vn is set to −V. In the present embodiment, the supply voltage vp and the supply voltage vn are +V and −V in the entire feeding operation of the sheet S and do not change. A zone from the time T1 to a time T2 indicated by (b) is an approach operation zone, and the conveyance velocity u1 is set to 0, and the conveyance velocity u2 is set to U. U indicates a velocity decided, for example, based on productivity of the image forming apparatus, and U is 200 mm/s in the present embodiment.

A zone from the time T2 to a time T3 indicated by (c) is a contact area increase operation zone, and subsequently to the time T1, the conveyance velocity u1 is set to 0, and the conveyance velocity u2 is set to the velocity U. A zone from the time T3 to a time T4 indicated by (d) is an adsorption operation zone, and the conveyance velocity u1 and the conveyance velocity u2 are set to 0. A zone from the time T4 to a time T5 indicated by (e) is a separation operation zone, and the conveyance velocity u1 is set to U, and the conveyance velocity u2 is set to 0. A zone from the time T5 to a time T6 indicated by (f) is a conveyance operation zone, and the conveyance velocity u1 and the conveyance velocity u2 are set to U.

The leading end detection pulse ps is output at a time Tp directly after the time T5. The controller 70 determines whether or not the feeding is retried according to whether or not the time Tp falls within a predetermined value range. A zone from the time T6 to a time T7 indicated by (a) is the initial operation zone again, and preparation for feeding of the next sheet S is performed. Thereafter, the above operation is repeated, and thus continuous sheet feeding is performed.

As described above, in the present embodiment, it is possible to cause the adsorbing member 200 to come into surface contact with the sheet and move the adsorption position at which the sheet is adsorbed, the separation position at which the adsorbed sheet is separated from the lower sheet while eliminating the bending, and the releasing position at which the adsorbed sheet is separated. Further, the adsorbing member 200 rotates to adsorb the sheet and hands the adsorbed sheet over to the pair of drawing rollers 51*d* and 51*e*, and thereafter, the adsorbing member 200 is stopped at a position (a standby position) away from the sheet. Thus, it is possible to separate and feed the sheet without moving the frame carrying the adsorbing member 200, the driving unit, the roller, and the like. As a result, it is possible to stably performing sheet feeding by the electrostatic adsorption at a low noise with a simple configuration. Further, the configuration of the present embodiment includes the first outer nip conveying roller 201*b* and the second outer nip conveying roller 202*b* that nip the adsorbing member 200 supported in a state in which the inside is loose by the first inner nip conveying roller 201*a* and the second inner nip conveying roller 202*b*. Thus, according to the configuration of the present embodiment, it is possible to increase the looseness amount of the adsorbing member 200 (it is possible to increase the deformation amount of the adsorbing member 200). Thus, according to the configuration of the present embodiment, since it is possible to sufficiently deform the sheet adsorbed on the adsorbing member 200, it is possible to separate the adsorbed sheet from the next sheet due to the stiffness of the sheet. Further, in the present embodiment, since the looseness amount of the adsorbing member 200 is large, it is possible to reduce the apparent stiffness of the adsorbing member 200, and thus it is possible to reduce a sound when the adsorbing member 200 comes into contact with the sheet. Further, in the present embodiment, since the adsorbing member 200 rotates while being nipped, it is possible to rotate the adsorbing member 200 without slipping. Thus, it is possible to cause the adsorbing member 200 to stably adsorb even a heavy sheet having a large basis weight.

Further, in the present embodiment, the first driving unit 203 and the second driving unit 204 are stopped during the initial operation. However, the first driving unit 203 and the second driving unit 204 may be driven at a constant velocity, and the sheet S and the adsorbing member 200 may be separated from each other by a predetermined gap. Further, during the approach operation and the contact area increase operation, the contact area is increased by causing the adsorbing member 200 to approach the sheet S according to the conveyance velocity difference between the pair of second nip conveying rollers 202 and the pair of first nip conveying rollers 201. However, the contact area may be increased by causing the adsorbing member 200 to approach the sheet S such that the rotation operation is performed in the opposite direction by the first driving unit 203, and the second driving unit 204 is stopped. In this case, the controller 70 causes the sheet S loaded on the loading unit to be adsorbed on the adsorbing member 200 by rotating the pair of first nip conveying rollers 201 in the opposite direction to the rotation direction of the pair of second nip conveying rollers 202 and increasing the downward looseness amount of the adsorbing member 200. Thereafter, the sheet S is fed by rotating the pair of first nip conveying rollers 201 in the same direction as the rotation direction of the pair of second nip conveying rollers 202.

Further, the first driving unit 203 and the second driving unit 204 are stopped during the adsorption operation, the first driving unit 203 and the second driving unit 204 may operate when the topmost sheet comes into surface contact with the adsorbing member 200 by the predetermined contact area Mn. Further, in the present embodiment, in each of the above operation processes, the positive voltage supply unit 205*a* and the negative voltage supply unit 205*b* are connected to the adsorbing member 200 so that the adsorption force is consistently generated, but the present embodiment is not limited to this example. For example, in only the three processes, that is, the adsorption operation, the separation operation, and the conveyance operation, the positive voltage supply unit 205*a* and the negative voltage supply unit 205*b* may be connected to generate the adsorption force.

In addition, in the present embodiment, the electrostatic adsorption force is generated between the adsorbing member 200 and the sheet S through the above-described configuration, but the present embodiment is not limited to this example. For example, the positive electrode 200*a* and the negative electrode 200*b* may not have the comb teeth shape and may have a shape of a uniform electrode in which the electric field can be formed between the electrodes 200*a* and 200*b* and the sheet S to dielectric-polarize the sheet S.

Figure 7:
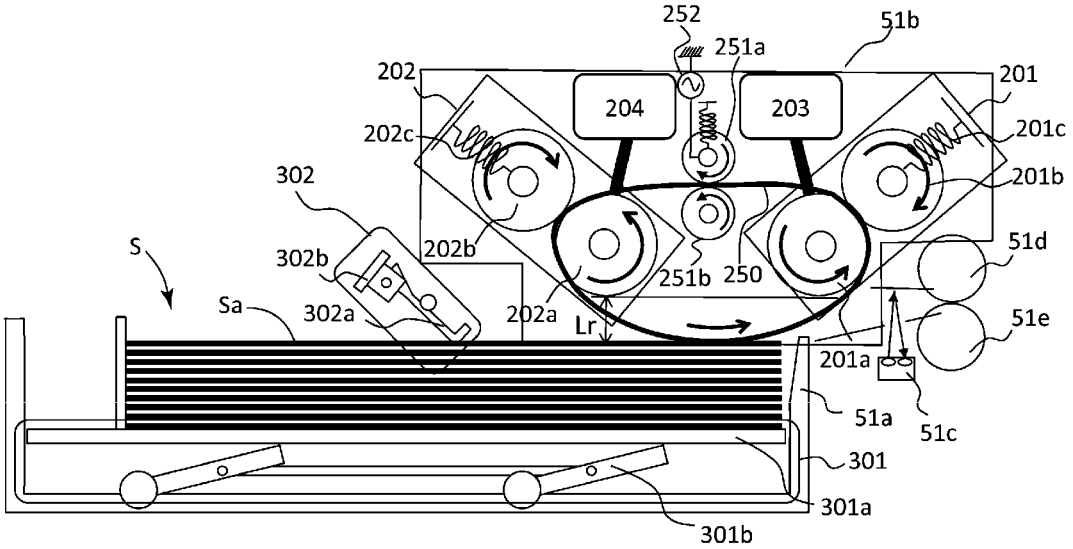
FIG. 7 is a diagram for describing a configuration of a sheet feeding device according to a second embodiment of the present invention.

Next, a second embodiment of the present invention will be described. FIG. 7 is a diagram for describing a configuration of a sheet feeding device according to the present embodiment. In FIG. 7, the same reference numerals as those in FIG. 2 denote the same or corresponding parts.

In FIG. 7, 250 indicates an adsorbing member, and 251*a* indicates a charging roller that is arranged above the adsorbing member 250 and presses the adsorbing member 250 downward. The charging roller 251*a* is rotatably supported by a shaft support member (not illustrated) whose arrangement position is fixed and drivenly rotates with the movement of the adsorbing member 250. An alternating current (AC) source 252 is connected to the charging roller 251*a* serving as the voltage applying member. As a result, charges are applied to the surface of the adsorbing member 250 through contact charging by the charging roller 251*a*, and the electrostatic adsorption force of attracting the sheet S is generated by the applied charges. 251*b* indicates a backup roller that is arranged at a position of the inner circumferential surface of the adsorbing member 250 corresponding to the charging roller 251*a* in order to cause the charging roller 251*a* to stably come into contact with the adsorbing member 250, and presses the adsorbing member 250 upward.

Figure 8A:
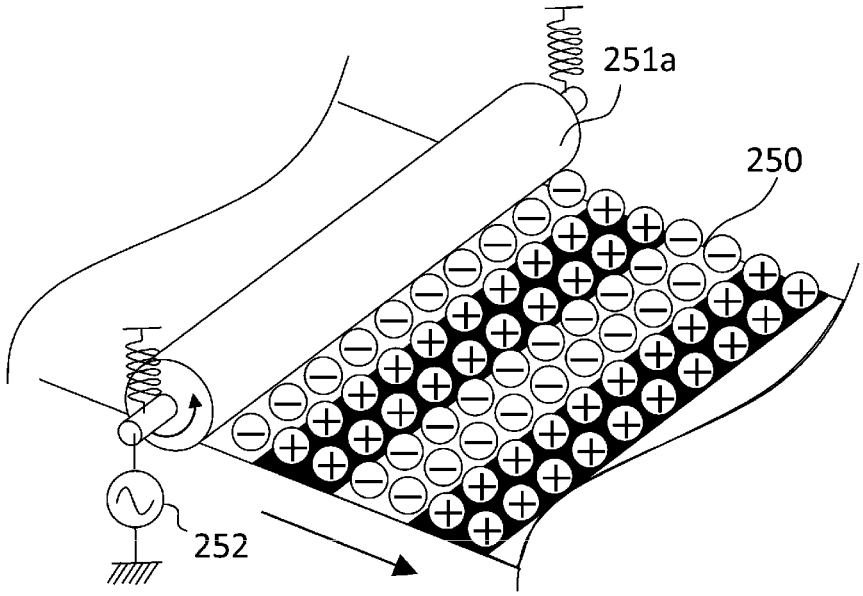
FIG. 8 is a diagram for describing a detailed configuration of an adsorbing member of a sheet adsorption separation feeding portion installed in the sheet feeding device and a generation principle of adsorption force by which the adsorbing member adsorbs a sheet.
Figure 8B:
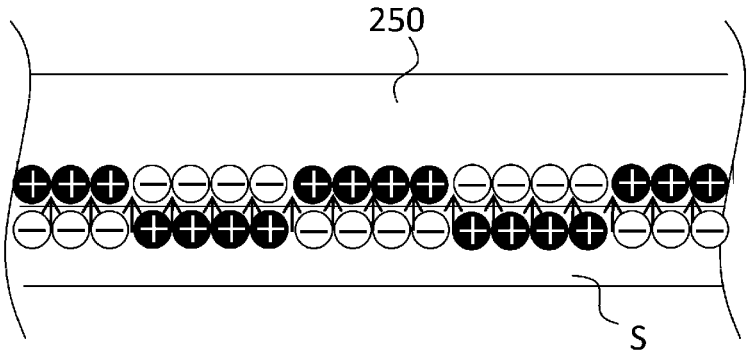

Next, a detailed configuration of the adsorbing member 250 and a generation principle of the adsorption force by which the adsorbing member 250 adsorbs the sheet S will be described with reference to FIG. 8. (a) of FIG. 8 is a perspective view of the adsorbing member 250, and (b) of FIG. 8 illustrates a cross section of the adsorbing member 250.

The adsorbing member 250 is a member having a single layer structure made of resin and serves as a dielectric having volume resistance of 108 Ωcm or more. In parallel with the conveyance operation of the adsorbing member 250 by the pair of second nip conveying rollers 202, an alternating voltage is applied from the charging roller 251*a* pressed on the surface of the adsorbing member 250. As a result, a region charged to a positive polarity and a region charged to a negative polarity are formed on the surface of the adsorbing member 250 in a stripe form at intervals corresponding to the frequency of the AC power source 252 and the surface moving velocity of the adsorbing member 250 as illustrated in (a) of FIG. 8. An unequal electric field is formed near the surface of the adsorbing member 250 by the positive and negative charged regions alternately formed in the stripe form. Further, when the adsorbing member 250 in which the unequal electric field is formed as described above approaches the sheet S, dielectric polarization occurs on the surface layer of the sheet serving as a dielectric, and the electrostatic adsorption force occurs between the adsorbing member 250 and the sheet S by Maxwell's stress.

As described above, in the present embodiment, it is possible to obtain the sheet adsorption force by charging the surface layer of the adsorbing member from the outside by the charging roller 251*a*. As a result, since it is possible to charge the adsorbing member 250 without the electrode arranged inside the adsorbing member, it is possible to simplify the configuration of the adsorbing member 250 and reduce the cost. Further, a DC power source may be connected to the charging roller 251*a* to form a charged region in which an entire surface has a homopolarity without forming the positive and negative charged regions alternately on the adsorbing member 250. In this case, the electrostatic adsorption force per unit area is reduced, but the electrostatic adsorption force can be generated more conveniently.

Figure 9:
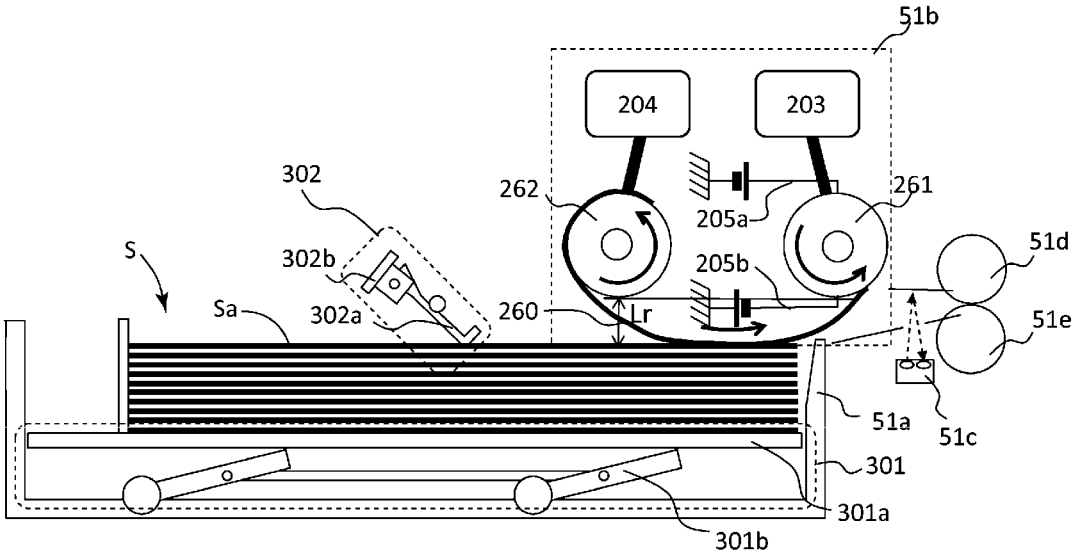
FIG. 9 is a diagram for describing a configuration of a sheet feeding device according to a third embodiment of the present invention.

Next, a third embodiment of the present invention will be described. FIG. 9 is a diagram for describing a configuration of a sheet feeding device according to the present embodiment. In FIG. 9, the same reference numerals as those in FIG. 2 denote the same or corresponding parts.

In FIG. 9, 260 is an open-ended belt like adsorbing member having flexibility, 261 indicates a winding roller (a first rotating member), and 262 indicates an unwinding roller (a second rotating member). The winding roller 261 and the unwinding roller 262 are arranged with a predetermined gap Lr from the top surface of the topmost sheet Sa loaded on the cassette 51*a*. The winding roller 261 is arranged in the downstream of the unwinding roller 262 in the sheet feeding direction. The adsorbing member 260 is fixed to the unwinding roller 262 at one end side and fixed to the winding roller 261 at the other end side.

Further, in the present embodiment, the gap between the winding roller 261 and the top surface of the topmost sheet Sa loaded on the cassette 51*a* and the gap between the unwinding roller 262 and the top surface of the topmost sheet loaded on the cassette 51*a* are described as being equal to each other, that is, Lr, but the gaps need not be necessarily equal to each other. Further, in the present embodiment, the adsorbing member 260 is supported by the two rollers 261 and 262, but when the adsorbing member 260 is supported by three or more rollers, the unwinding roller serves as the first rotary member in the uppermost stream in the sheet feeding direction. Further, the winding roller serves as the second rotary member in the lowermost stream in the sheet feeding direction.

The winding roller 261 is rotatably shaft-supported to a shaft support member (not illustrated) whose arrangement position is fixed, and driving force is transmitted to the winding roller 261 from the first driving unit 203 through the driving transmission unit (not illustrated). The unwinding roller 262 is rotatably shaft-supported to a shaft support member (not illustrated) whose arrangement position is fixed, and driving force is transmitted to the unwinding roller 262 from the second driving unit 204 through the driving transmission unit (not illustrated). Further, in the present embodiment, the first driving unit 203 and the second driving unit 204 perform positive rotation and reverse rotation, and thus reverse driving of the winding roller 261 and the unwinding roller 262 is possible.

The adsorbing member 260 has one end joined to the winding roller 261 and the other end joined to the unwinding roller 262, and moves forward and backward according to winding and rewinding operations of the winding roller 261 and unwinding and rewinding operations of the unwinding roller 262. The adsorbing member 260 is positioned at a side opposite to the top surface of the topmost sheet Sa to be able to come into contact with the top surface of the topmost sheet Sa.

Further, in the present embodiment, the length of the adsorbing member 260 is set to a length in which it is possible to secure a sheet contact area in which the sheet adsorption force necessary for the adsorption separation is obtained, and it is possible to convey the sheet S up to the pair of drawing rollers 51*d* and 51*e* in the downstream in the sheet conveyance. The positive voltage supply unit 205*a* and the negative voltage supply unit 205*b* are connected to the adsorbing member 260 through the winding roller 261. The electrostatic adsorption force of attracting the sheet S is generated in the adsorbing member 260 by the positive and negative voltages applied from the positive voltage supply unit 205*a* and the negative voltage supply unit 205*b*.

Figure 10:
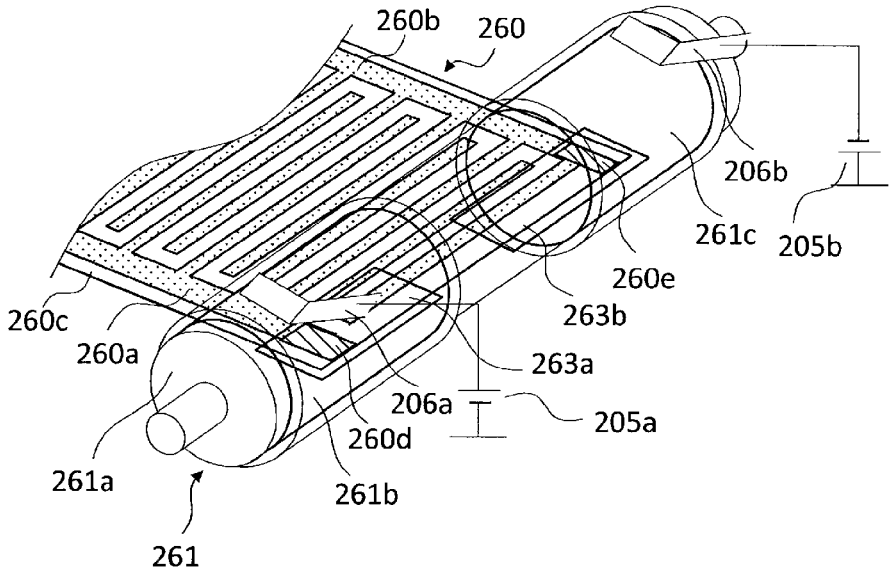
FIG. 10 is a diagram for describing a configuration of a sheet adsorption separation feeding portion installed in a sheet feeding device for supplying a voltage to an adsorbing member.
Figure 11A:
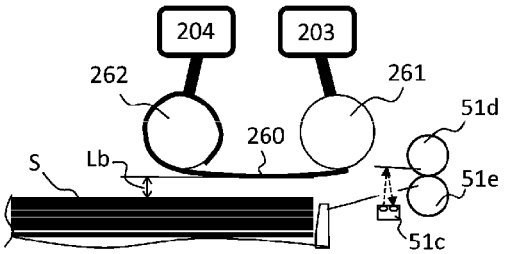
FIG. 11 is a diagram for describing a sheet separation feeding operation of the sheet adsorption separation feeding portion.
Figure 11B:
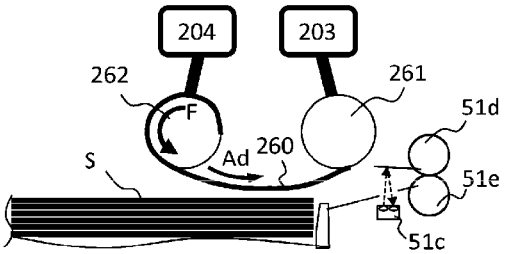
Figure 11C:
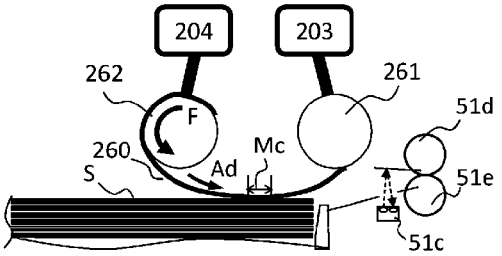
Figure 11D:
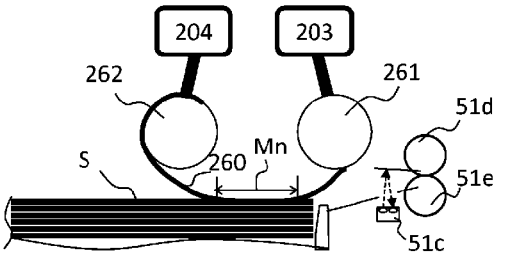
Figure 11E:
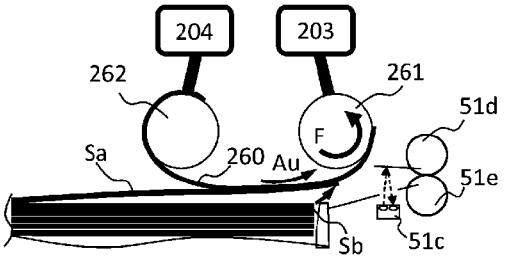
Figure 11F:
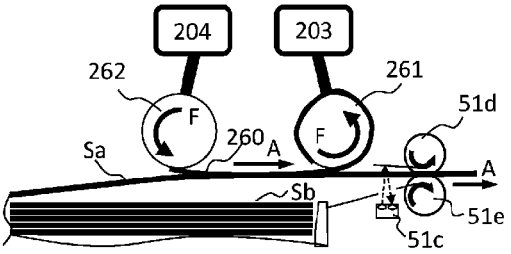
Figure 11G:
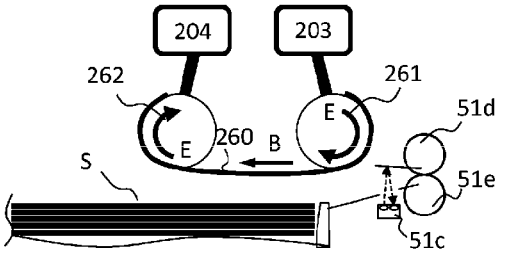

FIG. 10 is a schematic diagram illustrating a portion near a connection portion between the adsorbing member 260 and the positive voltage supply unit 205*a* and the negative voltage supply unit 205*b*. In FIG. 10, 260*c* indicates a base layer of the adsorbing member 260, and the positive electrode 260*a* and the negative electrode 260*b* are arranged on the base layer 260*c*. 263*a* and 263*b* are joining regions that are formed at one end of the adsorbing member 260 in the movement direction and joined with the winding roller 261. Electrode exposure regions 260*d* and 260*e* in which the positive electrode 260*a* and the negative electrode 260*b* are exposed are formed near the end portions of the joining regions 263*a* and 263*b* in the width direction orthogonal to the movement direction.

The winding roller 261 includes an insulating shaft member 261*a* and conductive power supply rings 261*b* and 261*c* each of which serves as a conducting portion fixed to outer circumferential surfaces of both end portions of the shaft member 261*a*. The electrode exposure region 260*d* of the adsorbing member 260 and the power supply ring 261*b* of the winding roller 261 are arranged inside one joining region 263*a*. The electrode exposure region 260*e* and the power supply ring 261*c* are arranged inside the other joining region 263*b*.

Here, flat springs 206*a* and 206*b* come into contact with the power supply rings 261*b* and 261*c*, and the positive and negative voltages are supplied from the positive voltage supply unit 205*a* and the negative voltage supply unit 205*b* to the flat springs 206*a* and 206*b*, respectively. In one joining region 263*a*, the positive electrode 260*a* of the adsorbing member 260 comes into contact with the power supply ring 261*b*, and the positive voltage is applied to the positive electrode 260*a* through the power supply ring 261*b*. In the other joining region 263*b*, the negative electrode 260*b* of the adsorbing member 260 comes into contact with the power supply ring 261*c*, and the negative voltage is applied to the negative electrode 260*b* through the power supply ring 261*c*.

Next, the sheet feeding operation of the sheet adsorption separation feeding portion 51*b* according to the present embodiment will be described with reference to FIG. 11. FIG. 11 is a schematic diagram chronologically illustrating an operation of feeding the sheet S through the sheet adsorption separation feeding portion 51*b*. The feeding operation of the sheet S includes seven processes chronologically, that is, an initial operation, an approach operation, a contact area increase operation, an adsorption operation, a separation operation, a conveyance operation, and a rewinding operation illustrated in (a) to (g) of FIG. 11. The processes will be described below in order.

The initial operation illustrated in (a) of FIG. 11 is an operation of arranging the adsorbing member 260 at an initial feed operation position. At the time of this operation, for example, the controller 70 illustrated in FIG. 4 causes the adsorbing member 260 to be separated from the sheet S by a predetermined gap Lb in a state in which the adsorbing member 260 is wound on the unwinding roller 262 side by a predetermined length, and stops the first driving unit 203 and the second driving unit 204.

The contact operation illustrated in (b) of FIG. 11 is an operation of causing the adsorbing member 260 to be bent downward and causing the adsorption surface side of the adsorbing member 260 to approach the topmost sheet Sa. At the time of this operation, the controller 70 causes the unwinding roller 262 to rotate in the arrow F direction through the second driving unit 204 and causes the adsorbing member 260 to be unwound in the arrow Ad direction. Further, at this time, the adsorbing member 260 is bent downward by stopping the winding roller 261 or causing the winding roller 261 to wind at a velocity slower than an unwinding velocity of the unwinding roller 262 through the first driving unit 203. As the adsorbing member 260 is bent downward as described above, the surface of the adsorbing member 260 comes into contact with the topmost sheet Sa.

A contact area increase operation illustrated in (c) of FIG. 11 is an operation of increasing the contact area Mc between the surface of the adsorbing member 260 and the topmost sheet Sa by performing the approach operation continuously. At the time of this operation, similarly to the approach operation, the controller 70 causes the unwinding roller 262 to rotate in the arrow F direction through the second driving unit 204, and causes the adsorbing member 260 to be conveyed in the arrow Ad direction. The contact area Mc is increased by stopping the winding roller 261 or causing the winding roller 261 to rotate slower than the unwinding roller 262 through the first driving unit 203. Then, the contact area increase operation is continued until the contact area Mc becomes equal to a predetermined contact area. Further, in the present embodiment, the size of the contact area Mc is not detected directly but alternatively detected using a difference in a conveyance amount between the unwinding roller 262 and the winding roller 261.

The adsorption operation illustrated in (d) of FIG. 11 is an operation of adsorbing the topmost sheet Sa in a state in which the top surface of the topmost sheet Sa comes into surface contact with the surface of the adsorbing member 260 by a predetermined contact area Mn. Here, the voltages are applied to the adsorbing member 260 through the positive and negative voltage supply units 205*a* and 205*b* as described above, the electrostatic adsorption force works between the adsorbing member 260 and the topmost sheet Sa. Then, the controller 70 stops the first driving unit 203 and the second driving unit 204 during a predetermined period of time in a state in which the topmost sheet Sa is adsorbed by the predetermined contact area Mn.

The separation operation illustrated in (e) of FIG. 11 is an operation of separating the topmost sheet Sa adsorbed on the adsorbing member 260 from the lower sheet Sb by causing the adsorbing member 260 to be deformed in substantially a straight line form from a state in which the adsorbing member 260 is bent downward. At the time of this operation, the controller 70 causes the adsorbing member 260 to be wound in the arrow Au direction by rotating the winding roller 261 through the first driving unit 203. Further, the controller 70 eliminates the bending by stopping the unwinding roller 262 or causing the unwinding roller 262 to be unwound at a velocity slower than the winding velocity of the winding roller 261 through the second driving unit 204, and causes the adsorbing member 260 to be deformed in substantially the straight line form.

The conveyance operation illustrated in (f) of FIG. 11 is an operation of conveying the adsorbing member 260 deformed in substantially the straight line form and feeding the adsorbed topmost sheet Sa to the pair of drawing rollers 51*d* and 51*e*. At the time of this operation, the controller 70 sets the winding velocity of the winding roller 261 to be substantially equal to the unwinding velocity of the unwinding roller 262, and conveys the adsorbing member 260 adsorbing the topmost sheet Sa in a state in which the adsorption surface side is maintained in substantially the straight line form. As a result, the topmost sheet Sa is conveyed in the arrow A direction while maintaining the state in which the topmost sheet Sa is separated from the lower sheet Sb.

Thereafter, when the leading end of the topmost sheet Sa reaches near the curved portion of the adsorbing member 260 formed by the winding roller 261, the leading end of the sheet Sa is peeled off from the adsorbing member 260. The peeling occurs since the bending reaction force of the sheet Sa is larger than the electrostatic adsorption force generated in the adsorbing member 260. After the leading end is peeled off from the adsorbing member 260 as described above, the peeling of the sheet Sa is increased starting from the leading end, but the rear end region of the sheet Sa is adsorbed by the adsorbing member 260. As a result, the sheet Sa is continuously conveyed by the adsorbing member 260 and then handed over to the pair of drawing rollers 51*d* and 51*e* through detection of the leading end by the sheet leading end detecting sensor 51*c*. Here, when the sheet Sa has not been detected during a predetermined period of time by the sheet leading end detecting sensor 51*c*, the controller 70 determines that there is a mistake in the feeding operation of the sheet Sa and resumes the feeding operation starting from the approach operation.

The rewinding operation illustrated in (g) of FIG. 11 is an operation of rewinding the adsorbing member 260 by reversely rotating the first driving unit 203 and the second driving unit 204 after the sheet Sa is handed over to the pair of drawing rollers 51*d* and 51*e* through the conveyance operation. Then, the adsorbing member 260 is rewound in an arrow B direction by a predetermined length through the winding roller 261 and the unwinding roller 262, and thus the adsorbing member 260 returns to the standby position that is the initial operation position illustrated in (a) of FIG. 11. One topmost sheet Sa is fed from a plurality of sheets S loaded on the cassette 51*a* through the above seven processes. Further, it is possible to continuously feed the sheets S one by one by repeatedly performing the seven processes.

Figure 12:
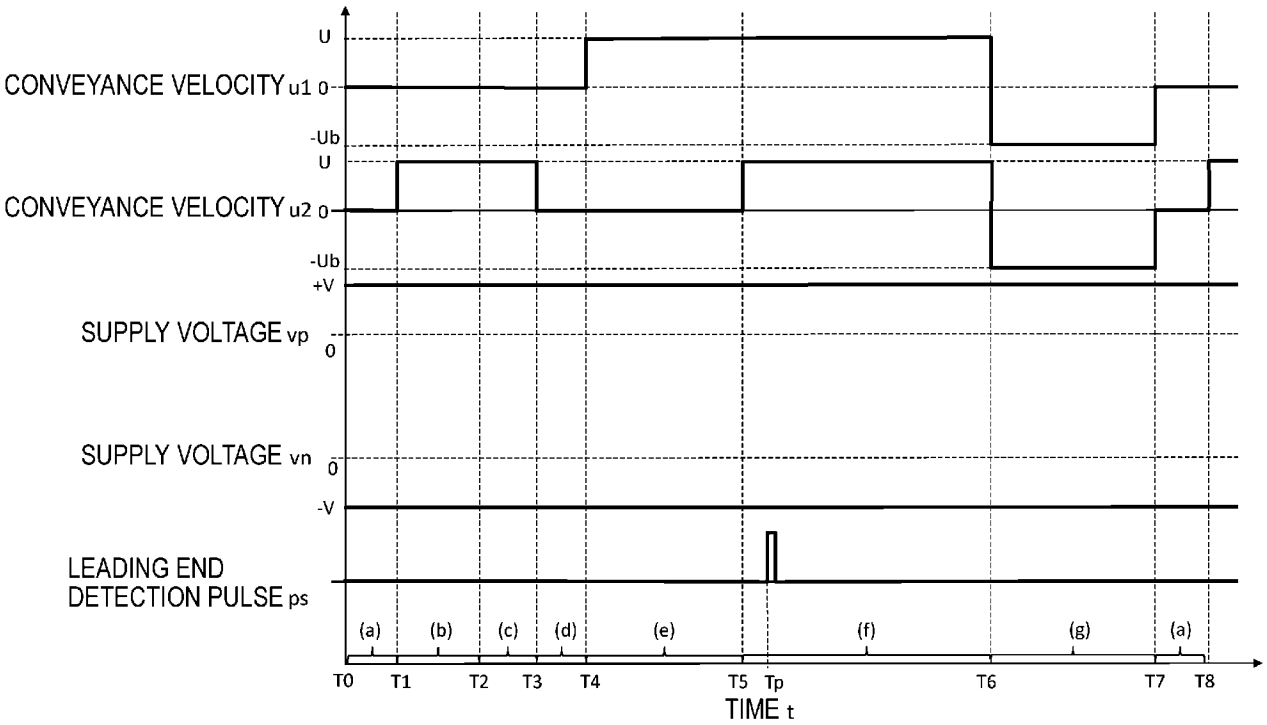
FIG. 12 is a timing chart of a time of sheet separation feeding of the sheet adsorption separation feeding portion.

FIG. 12 is a timing chart of the initial operation, the approach operation, the contact area increase operation, the adsorption operation, the separation operation, the conveyance operation, and the rewinding operation illustrated in FIG. 11. In FIG. 12, a zone from a time T to a time T1 indicated by (a) is an initial operation zone, and at this time, the conveyance velocity u1 and the conveyance velocity u2 are set to 0, the supply voltage vp is set to +V, and the supply voltage vn is set to −V. A zone from the time T1 to a time T2 indicated by (b) is an approach operation zone, and the conveyance velocity u1 is set to 0, and the conveyance velocity u2 is set to U. U indicates a velocity decided, for example, based on productivity of the image forming apparatus, and U is 200 mm/s in the present embodiment.

A zone from the time T2 to a time T3 indicated by (c) is a contact area increase operation zone, and subsequently to the time T1, the conveyance velocity u1 is set to 0, and the conveyance velocity u2 is set to the velocity U. A zone from the time T3 to a time T4 indicated by (d) is an adsorption operation zone, and the conveyance velocity u1 and the conveyance velocity u2 are set to 0. A zone from the time T4 to a time T5 indicated by (e) is a separation operation zone, and the conveyance velocity u1 is set to U, and the conveyance velocity u2 is set to 0. A zone from the time T5 to a time T6 indicated by (f) is a conveyance operation zone, and the conveyance velocity u1 and the conveyance velocity u2 are set to U. The leading end detection pulse ps is output at a time Tp directly after the time T5. The controller 70 determines whether or not the feeding is retried according to whether or not the time Tp falls within a predetermined value range.

A zone from the time T6 to a time T7 indicated by (g) is a rewinding operation zone, and the conveyance velocity u1 and the conveyance velocity u2 are set to −Ub. A zone from the time T7 to a time T8 indicated by (a) is the initial operation zone, and preparation for feeding of the next sheet S is performed. Thereafter, the above operation is repeated, and thus continuous sheet feeding is performed.

As described above, in the present embodiment, the adsorbing member 260 has the open-ended shape rather than the endless shape, and thus it is possible to further simplify the configuration of the adsorbing member 260 and reduce the cost. Further, in the present embodiment, during the approach operation and the contact area increase operation, the contact area is increased by causing the adsorbing member 260 to approach the sheet S according to the difference between the winding velocity of the winding roller 261 and the unwinding velocity of the unwinding roller 262. However, the contact area may be increased by causing the adsorbing member 260 to approach the sheet S such that the first driving unit 203 reversely rotates, and the second driving unit is stopped.

Further, during the adsorption operation, the first driving unit 203 and the second driving unit 204 are stopped, but the first driving unit 203 and the second driving unit 204 may operate when the top surface of the topmost sheet comes into contact with the surface of the adsorbing member 260 by a predetermined area. Further, in the present embodiment, in each of the above operation processes, the positive voltage supply unit 205*a* and the negative voltage supply unit 205*b* are connected to the adsorbing member 260 so that the adsorption force is consistently generated, but the present embodiment is not limited to this example. For example, in only the three processes, that is, the adsorption operation, the separation operation, and the conveyance operation, the positive voltage supply unit 205*a* and the negative voltage supply unit 205*b* may be connected so that the adsorption force is generated in the adsorbing member 260.

Figure 13:
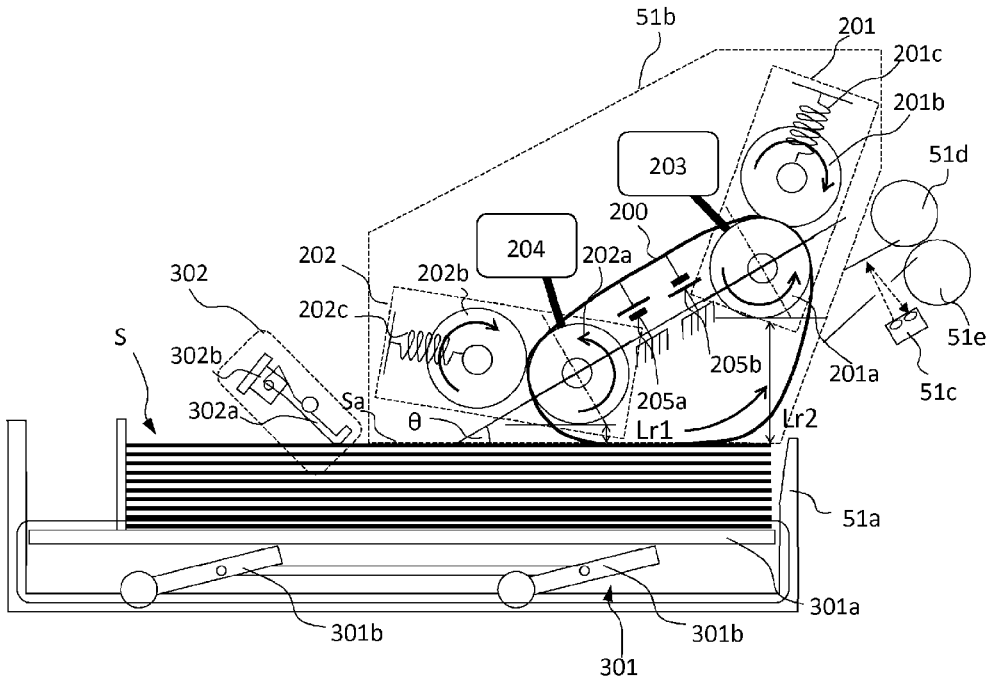
FIG. 13 is a diagram for describing a configuration of a sheet feeding device according to a fourth embodiment of the present invention.

Next, a fourth embodiment of the present invention will be described. FIG. 13 is a diagram for describing a configuration of a sheet feeding device according to the present embodiment. In FIG. 13, the same reference numerals as those in FIG. 2 denote the same or corresponding parts.

In FIG. 13, in the sheet adsorption separation feeding portion 51*b*, a gap of Lr1 is formed between the topmost sheet Sa loaded on the cassette 51*a* and the pair of second nip conveying rollers 202, and a gap of Lr2 is formed between the topmost sheet Sa and the pair of first nip conveying rollers 201. In other words, the topmost sheet Sa and the sheet adsorption separation feeding portion 51*b* are arranged at an angle θ. On the other hand, the adsorbing member 200 with which the sheet adsorption separation feeding portion 51*b* is equipped is installed to have the length capable of separating the topmost sheet by adsorption while being nipped between the pair of first nip conveying rollers 201 and the pair of second nip conveying rollers 202.

Figure 14:
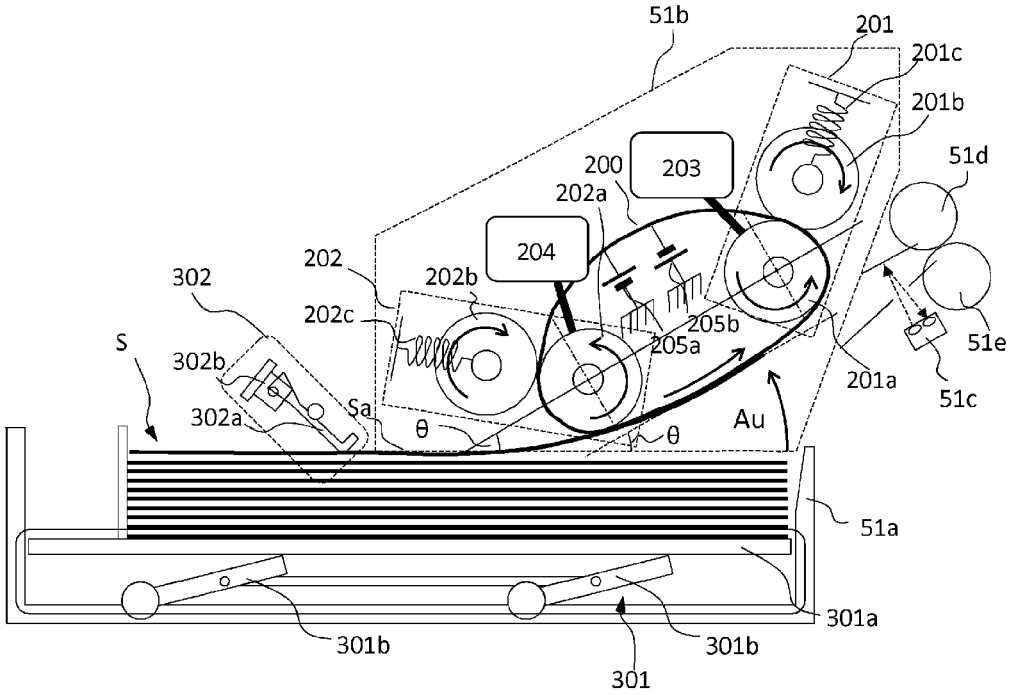
FIG. 14 is a diagram for describing a sheet separation position of a sheet adsorption separation feeding portion installed in the sheet feeding device.

Next, effects of the present embodiment for separation of the topmost sheet Sa will be described with reference to FIG. 14. FIG. 14 is a schematic diagram illustrating the sheet separation operation. In FIG. 14, the topmost sheet Sa adsorbed on the adsorbing member 200 is rolled up in the arrow Au direction with the separation operation and deformed to be bent at an angle of about θ. In the case of the present embodiment, the deformation amount of the topmost sheet Sa can be increased to be larger than that in the first embodiment. Thus, for example, even when the lower sheet Sb adheres to the topmost sheet Sa by an end burr or the like, sufficient separation performance can be obtained by the stiffness of the sheet. Further, the pair of drawing rollers 51*d* and 51*e* that nips the sheet Sa after the separation and conveyance operations of the sheet Sa is arranged on an extension line on which the sheet Sa is curved at an angle of about θ.

Figure 15:
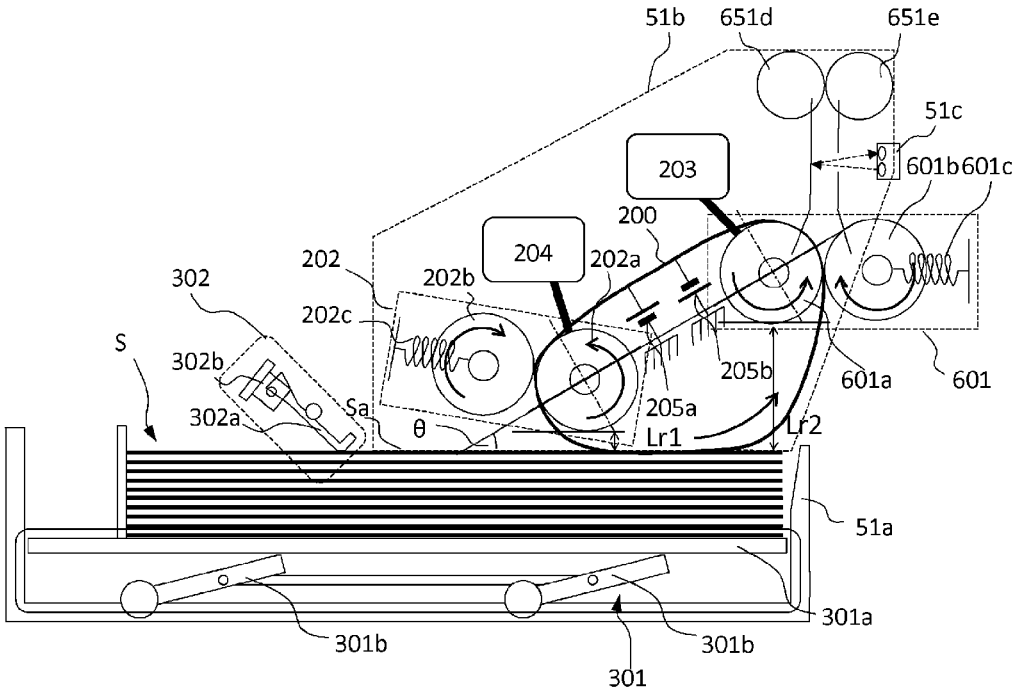
FIG. 15 is a diagram for describing a configuration of a sheet feeding device according to a fifth embodiment of the present invention.

Next, a fifth embodiment of the present invention will be described. FIG. 15 is a diagram for describing a configuration of a sheet feeding device according to the present embodiment. In FIG. 15, the same reference numerals as those in FIG. 13 denote the same or corresponding parts.

In FIG. 15, 601 indicates a pair of first nip conveying rollers, and the pair of first nip conveying rollers 601 includes a first inner nip conveying roller 601*a* and a first outer nip conveying roller 601*b* pressed again the first inner nip conveying roller 601*a* by a first pressing spring 601*c*. Similarly to the second inner nip conveying roller 202*a*, the first inner nip conveying roller 601*a* is arranged inside the adsorbing member 200 and rotatably shaft-supported by a shaft support member (not illustrated) whose arrangement position is fixed. Further, driving from the first driving unit 203 is transmitted to the first inner nip conveying roller 601*a* through a driving transmission unit (not illustrated). Further, the pair of first nip conveying rollers 601 has a function of nipping and conveying the topmost sheet Sa that has been adsorbed and separated as well while nipping and conveying the adsorbing member 200.

651 indicates a pair of sheet conveying rollers configured with two sheet conveying rollers 651*d* and 651*e*, and the pair of sheet conveying rollers 651 is arranged above an outlet of the pair of first nip conveying rollers 601. The topmost sheet Sa nipped and conveyed by the pair of first nip conveying rollers 601 is continuously nipped and conveyed to the pair of sheet conveying rollers 651 and fed up to a pre-secondary transfer conveyance path.

Next, the sheet separation feeding operation of the sheet adsorption separation feeding portion 51*b* according to the present embodiment will be described with reference to FIG. 16. (a) and (b) of FIG. 16 are schematic diagrams illustrating states before and after the topmost sheet Sa is nipped between the pair of first nip conveying rollers 601 during the conveyance operation.

Figure 16A:
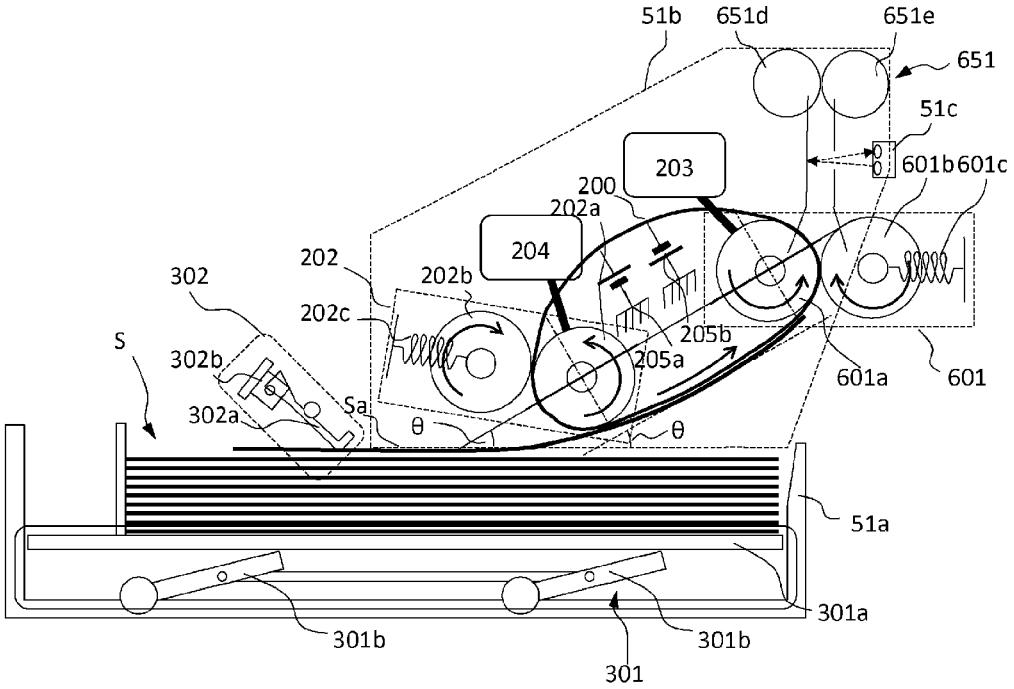
FIG. 16 is a diagram for describing a sheet separation feeding operation of a sheet adsorption separation feeding portion installed in the sheet feeding device.
Figure 16B:
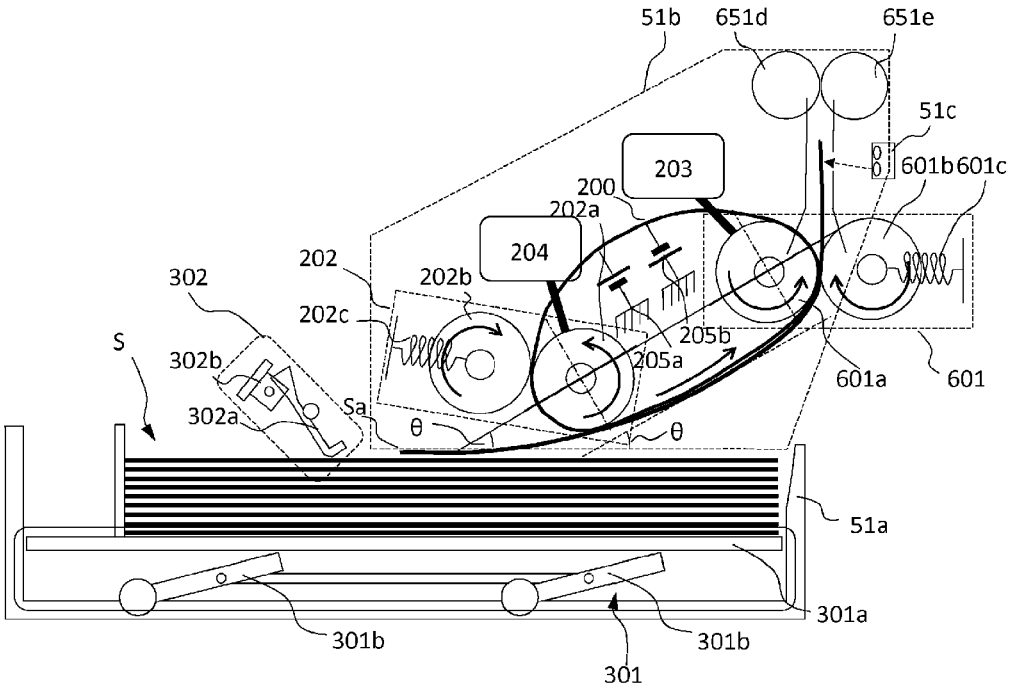

In (a) of FIG. 16, after the separation operation, the topmost sheet Sa is adsorbed and conveyed up to a portion near the pair of first nip conveying rollers 601 together with the adsorbing member 200 conveyed by the pair of first nip conveying rollers 601 and the pair of second nip conveying rollers 202. In the present embodiment, the nip portion of the pair of first nip conveying rollers 601 is arranged on an extension line of the sheet Sa in the conveyance direction.

For this reason, the sheet Sa near the pair of first nip conveying rollers 601 reaches the nip portion of the pair of first nip conveying rollers 601 before being separated at the same curvature and nipped and conveyed together with the adsorbing member 200. In (b) of FIG. 16, the sheet Sa nipped and conveyed by the pair of first nip conveying rollers 601 is handed over to the pair of sheet conveying roller 651 arranged above the pair of first nip conveying rollers 601, and the conveyance operation of the sheet Sa is completed.

As described above, in the present embodiment, the pair of first nip conveying rollers 601 of the adsorbing member 200 has the function of nipping and conveying the sheet Sa, and thus the sheet Sa can be fed directly to the upper portion of the sheet adsorption separation feeding portion 51*b*. As a result, since it is unnecessary to form a sheet conveyance path at the right surface side of the image forming apparatus body 100A, the space of the image forming apparatus body 100A can be saved, and the number of parts can be reduced.

In the embodiment described so far, the sheet S is adsorbed on the adsorbing member by the electrostatic adsorption force, but the present invention is not limited to this example. For example, a fine fiber structure of a submicron order may be formed on the adsorbing member, and the sheet S may adsorbed by intermolecular attractive force working between the sheet S and the fine fiber structure.

REFERENCE SIGNS LIST

51, 52 Sheet feeding device
51*a* Cassette
51*b*, 52*b* Sheet adsorption separation feeding portion
51*c* Sheet leading end detecting sensor
51*d*, 51*e* Pair of drawing rollers

55 Image forming portion
70 Controller
100 Image forming apparatus
100A Image forming apparatus body
200 Adsorbing member
200*a* Positive electrode
200*b* Negative electrode
201 Pair of first nip conveying rollers
201*a* First inner nip conveying roller
201*b* First outer nip conveying roller
202 Pair of second nip conveying rollers
202*a* Second inner nip conveying roller
202*b* Second outer nip conveying roller
203 First driving unit
204 Second driving unit
205 Power source unit
205*a* Positive voltage supply unit
205*b* Negative voltage supply unit
206 Adsorbing member position detecting sensor
250 Adsorbing member
250*a* Charging roller
251*a* Charging roller
251*c* Charging roller
252 AC power source
260 Adsorbing member
261 Winding roller
261*b*, 261*c* Power supply ring
262 Unwinding roller
601 Pair of first nip conveying rollers
651 Pair of sheet conveying rollers
Mn Sheet contact area
S Sheet
Sa Topmost sheet

The invention claimed is:

1. A sheet feeding device, comprising:

a loading unit that loads a sheet;

a first rotating member that is arranged above the loading unit;

a second rotating member that is arranged upstream in a sheet feed direction of the first rotating member;

an adsorbing member in which an inside is supported in a loose state by the first rotating member and the second rotating member and electrically adsorbs the sheet loaded on the loading unit;

a first nip member that, together with the first rotating member, nips the adsorbing member;

a second nip member that, together with the second rotating member, nips the adsorbing member;

a driving unit that rotates the first rotating member, the first nip member, the second rotating member, and the second nip member;

a power source that applies a voltage to the adsorbing member and provides adsorption force of adsorbing the sheet by static electricity; and a control unit configured to control the driving unit, wherein the control unit causes the sheet loaded on the loading unit to be adsorbed on the adsorbing member by increasing a downward looseness amount of the adsorbing member and then feeds the sheet adsorbed on the adsorbing member while reducing the downward looseness amount of the adsorbing member, wherein a distance between the first rotating member and the sheet loaded on the loading unit is larger than a distance between the second rotating member and the sheet loaded on the loading unit, wherein two electrodes are arranged in the adsorbing member and the power source includes a first power source that applies a positive voltage to one of the two electrodes and a second power source that applies a negative voltage to the other of the two electrodes, and wherein a conducting portion is formed in at least one of the first nip member and the second nip member, one of the first power source and the second power source is connected to one of the two electrodes of the adsorbing member through the conducting portion, and the other of the first power source and the second power source is connected to the other of the two electrodes of the adsorbing member through the conducting portion.

2. The sheet feeding device according to claim 1, wherein the driving unit includes a first driving unit that rotates the first rotating member and the first nip member and a second driving unit that rotates the second rotating member and the second nip member, and the control unit causes the sheet loaded on the loading unit to be adsorbed on the adsorbing member by increasing the downward looseness amount of the adsorbing member such that the first rotating member and the first nip member rotate at a velocity slower than the second rotating member and the second nip member, and then feeds the sheet adsorbed on the adsorbing member while reducing the downward looseness amount of the adsorbing member such that the second rotating member and the second nip member rotate at a velocity slower than the first rotating member and the first nip member.

3. The sheet feeding device according to claim 1, wherein the driving unit includes a first driving unit that rotates at least the first rotating member and the first nip member, and the control unit causes the sheet loaded on the loading unit to be adsorbed on the adsorbing member by increasing the downward looseness amount of the adsorbing member such that the first rotating member and the first nip member rotate in a direction opposite to a rotation direction of the second rotating member and the second nip member, and then feeds the sheet adsorbed on the adsorbing member while reducing the downward looseness amount of the adsorbing member such that the first rotating member and the first nip member rotate in the same direction as a rotation direction of the second rotating member and the second nip member.

4. The sheet feeding device according to claim 1, wherein the first nip member has a function of nipping and conveying the sheet adsorbed by the adsorbing member as well.

5. The sheet feeding device according to claim 1, wherein the adsorbing member has flexibility, and is arranged to be movable to a standby position away from the sheet loaded on the loading unit, an adsorption position at which the sheet loaded on the loading unit is adsorbed, a separation position at which the adsorbed sheet moves upwards and is separated from a lower sheet, and a releasing position at which the adsorbed sheet is separated from the adsorbing member.

6. The sheet feeding device according to claim 1, further comprising, a voltage applying member that is arranged between the adsorbing member and a power source, and abuts the adsorbing member to apply a voltage from the power source to the adsorbing member before the adsorbing member comes into contact with the sheet.

7. The sheet feeding device according to claim 6,
wherein the power source is an alternating current (AC) power source.

8. The sheet feeding device according to claim 1,
wherein a magnitude of adsorption force by the static electricity when looseness of the adsorbing member is eliminated is set to a magnitude by which the sheet is separated from the adsorbing member due to stiffness of the sheet.

9. The sheet conveyance device according to claim 1, wherein
the absolute value of the positive voltage applied by the first power source is substantially the same as the absolute value of the negative voltage applied by the second power source.

10. A sheet feeding device, comprising:
a loading unit that loads a sheet;
a first rotating member that is arranged above the loading unit;
a second rotating member that is arranged in an upstream further than the first rotating member in a sheet feed direction;
an adsorbing member that includes one end side fixed to the first rotating member and the other end side fixed to the second rotating member, and electrically adsorbs the sheet loaded on the loading unit;
a first driving unit that is able to rotate the first rotating member positively and reversely;
a second driving unit that is able to rotate the second rotating member positively and reversely; and
a control unit that controls the first driving unit and the second driving unit,
wherein the control unit causes the sheet loaded on the loading unit to be adsorbed on the adsorbing member by increasing a downward looseness amount of the adsorbing member, and then feeds the sheet adsorbed on the adsorbing member while reducing the downward looseness amount of the adsorbing member, and
the control unit returns the adsorbing member to a standby position by rotating the first rotating member and the second rotating member reversely after the sheet is fed.

11. The sheet feeding device according to claim 10,
wherein two electrodes are arranged in the adsorbing member, and the power source includes a first power source that applies a positive voltage to one of the two electrodes and a second power source that applies a negative voltage to the other of the two electrodes.

12. The sheet feeding device according to claim 10,
wherein two electrodes are arranged in the adsorbing member,
the power source includes a first power source that applies a positive voltage to one of the two electrodes and a second power source that applies a negative voltage to the other of the two electrodes, and
a conducting portion is formed in at least one of the first rotating member and the second rotating member, one of the first power source and the second power source is connected to one of the two electrodes of the adsorbing member through the conducting portion, and the other of the first power source and the second power source is connected to the other of the two electrodes of the adsorbing member through the conducting portion.

13. An image forming apparatus, comprising:
an image forming portion that forms an image on a sheet;
a loading unit that loads a sheet;
a first rotating member that is arranged above the loading unit;
a second rotating member that is arranged in an upstream further than the first rotating member in a sheet feed direction;
an adsorbing member in which an inside is supported in a loose state by the first rotating member and the second rotating member and electrically adsorbs the sheet loaded on the loading unit;
a first nip member that nips the adsorbing member together with the first rotating member;
a second nip member that nips the adsorbing member together with the second rotating member;
a driving unit that rotates the first rotating member, the first nip member, the second rotating member, and the second nip member;
a power source that applies a voltage to the adsorbing member and provides adsorption force of adsorbing the sheet by static electricity; and
a control unit configured to control the driving unit,
wherein the control unit causes the sheet loaded on the loading unit to be adsorbed on the adsorbing member by increasing a downward looseness amount of the adsorbing member and the feeds the sheet adsorbed on the adsorbing member while reducing the downward looseness amount of the adsorbing member,
wherein a distance between the first rotating member and the sheet loaded on the loading unit is larger than a distance between the second rotating member and the sheet loaded on the loading unit,
wherein two electrodes are arranged in the adsorbing member and the power source includes a first power source that applies a positive voltage to one of the two electrodes and a second power source that applies a negative voltage to the other of the two electrodes, and
wherein a conducting portion is formed in at least one of the first nip member and the second nip member, one of the first power source and the second power source is connected to one of the two electrodes of the adsorbing member through the conducting portion, and the other of the first power source and the second power source is connected to the other of the two electrodes of the adsorbing member through the conducting portion.

14. The image forming apparatus according to claim 13, wherein
the absolute value of the positive voltage applied by the first power source is substantially the same as the absolute value of the negative voltage applied by the second power source.

* * * * *